US010427412B2

(12) United States Patent
Okude et al.

(10) Patent No.: US 10,427,412 B2
(45) Date of Patent: Oct. 1, 2019

(54) LIQUID EJECTING APPARATUS AND LIQUID REFILLING CONTAINER

(71) Applicant: CANON KABUSHIKI KAISHA, Tokyo (JP)

(72) Inventors: Kyoshiro Okude, Kawasaki (JP); Masateru Komori, Yokohama (JP); Masato Koshimizu, Kawasaki (JP); Tsuyoshi Saeki, Kawasaki (JP); Yukimichi Kimura, Kawasaki (JP); Masahiro Kawanishi, Yokohama (JP); Masaaki Matsuura, Kawasaki (JP); Katsuyuki Yokoi, Yokohama (JP); Akira Shiba, Machida (JP); Ryo Shimamura, Yokohama (JP); Kazuya Yoshii, Yokohama (JP); Norihiro Ikebe, Kawasaki (JP); Takeho Miyashita, Yokohama (JP); Tomoki Yamamuro, Kawasaki (JP); Atsushi Arai, Yokohama (JP); Masatoshi Ohira, Fujisawa (JP); Tatsuaki Orihara, Tokyo (JP); Hirofumi Okuhara, Tokyo (JP); Kazumasa Matsushita, Kawasaki (JP); Misato Furuya, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/590,762

(22) Filed: May 9, 2017

(65) Prior Publication Data

US 2017/0326882 A1 Nov. 16, 2017

(30) Foreign Application Priority Data

May 16, 2016 (JP) ..... 2016-098057

(51) Int. Cl.
*B41J 2/175* (2006.01)
*B41J 2/03* (2006.01)
(Continued)

(52) U.S. Cl.
CPC ..... *B41J 2/17506* (2013.01); *B41J 2/03* (2013.01); *B41J 2/17533* (2013.01);
(Continued)

(58) Field of Classification Search
CPC ..... B41J 2/03; B41J 2/17533; B41J 2/2125; B41J 2/175; B41J 2/17503; B41J 2/01;
(Continued)

(56) References Cited

U.S. PATENT DOCUMENTS 4,907,019 A 3/1990 Stephens ..... 346/140 R
5,040,000 A 8/1991 Yokoi ..... 347/30
(Continued)

FOREIGN PATENT DOCUMENTS

JP H04-164649 6/1992
JP H09-156120 6/1997
(Continued)

OTHER PUBLICATIONS

U.S. Appl. No. 15/489,437, filed Apr. 17, 2017.
(Continued)

*Primary Examiner* — Julian D Huffman
(74) *Attorney, Agent, or Firm* — Venable LLP

(57) ABSTRACT

An object is to provide a liquid ejecting apparatus that enables a liquid storage container to be properly and easily refilled with a liquid from a liquid refilling container without causing color mixture in the liquid storage container. The liquid ejecting apparatus includes liquid storage containers each configured to feed the liquid to a liquid ejecting portion and liquid refilling containers each configured to refill the liquid storage container with the liquid. A first fitting unit is
(Continued)

provided around a liquid injection port in each of the liquid storage containers. A second fitting unit is provided around a liquid pour-out port in each of the liquid refilling containers. The second fitting unit is fitted to the first fitting unit to enable the liquid to be delivered from the liquid pour-out port to the liquid injection port.

12 Claims, 18 Drawing Sheets

(51) Int. Cl.
*B41J 2/21* (2006.01)
*B41J 2/01* (2006.01)

(52) U.S. Cl.
CPC ..... *B41J 2/2125* (2013.01); *B41J 2/01* (2013.01); *B41J 2/175* (2013.01); *B41J 2/1753* (2013.01); *B41J 2/17503* (2013.01); *B41J 2/21* (2013.01)

(58) Field of Classification Search
CPC ..... B41J 2/1753; B41J 2/21; B41J 2/17506; B41J 2/17509
See application file for complete search history.

(56) References Cited

U.S. PATENT DOCUMENTS

| | | | | |
|---|---|---|---|---|
| 5,162,817 | A | 11/1992 | Tajika et al. | 347/7 |
| 5,179,389 | A | 1/1993 | Arai et al. | 347/7 |
| 5,355,158 | A | 10/1994 | Inada et al. | 347/22 |
| 5,381,169 | A | 1/1995 | Arai et al. | 347/33 |
| 5,398,054 | A | 3/1995 | Fukazawa et al. | 347/33 |
| 5,479,193 | A | 12/1995 | Shimoda et al. | 347/7 |
| 5,504,512 | A | 4/1996 | Shimoda et al. | 347/86 |
| 5,534,898 | A | 7/1996 | Kashino et al. | 347/33 |
| 5,606,354 | A | 2/1997 | Bekki et al. | 347/33 |
| 5,646,655 | A | 7/1997 | Iwasaki et al. | 347/17 |
| 5,748,207 | A | 5/1998 | Inui et al. | 347/43 |
| 5,777,649 | A | 7/1998 | Otsuka et al. | 347/94 |
| 5,831,652 | A | 11/1998 | Hinami et al. | 347/86 |
| 5,920,333 | A * | 7/1999 | Bates | B41J 2/17506 347/85 |
| 5,980,021 | A | 11/1999 | Nagoshi et al. | 347/49 |
| 5,984,449 | A | 11/1999 | Tajika et al. | 347/15 |
| 5,988,783 | A | 11/1999 | Tajika et al. | 347/7 |
| 6,007,184 | A | 12/1999 | Terasawa et al. | 347/50 |
| 6,015,203 | A | 1/2000 | Arai et al. | 347/33 |
| 6,048,047 | A | 4/2000 | Terasawa et al. | 347/30 |
| 6,050,669 | A | 4/2000 | Yano et al. | 347/23 |
| 6,241,350 | B1 | 6/2001 | Otsuka et al. | 347/94 |
| 6,345,888 | B1 | 2/2002 | Matsumoto et al. | 347/86 |
| 6,402,308 | B1 | 6/2002 | Hattori et al. | 347/86 |
| 6,476,926 | B1 | 11/2002 | Yano et al. | 358/1.14 |
| 6,505,923 | B1 | 1/2003 | Yamamoto et al. | 347/85 |
| 6,719,395 | B2 | 4/2004 | Iwasaki et al. | 347/19 |
| 7,753,087 | B2 * | 7/2010 | Rhodenbaugh | A47K 5/1204 141/18 |
| 7,874,660 | B2 * | 1/2011 | Haines | B41J 2/175 220/233 |
| 7,984,825 | B2 * | 7/2011 | Ophardt | A47K 5/1217 222/1 |
| 8,079,664 | B2 * | 12/2011 | Silverbrook | B41J 2/14427 347/42 |
| 8,529,035 | B2 | 9/2013 | Tsukamoto et al. | 347/86 |
| 8,529,037 | B2 | 9/2013 | Miyashita et al. | 347/86 |
| 8,770,730 | B2 | 7/2014 | Nanjo et al. | 347/86 |
| 8,770,731 | B2 | 7/2014 | Miyashita et al. | 347/86 |
| 8,960,869 | B2 | 2/2015 | Takada et al. | 347/86 |
| 8,960,875 | B2 | 2/2015 | Shiba et al. | 347/93 |
| 9,016,842 | B2 | 4/2015 | Miyashita et al. | 347/86 |
| 9,139,012 | B2 | 9/2015 | Yamada et al. | B41J 2/17553 |
| 9,242,471 | B2 | 1/2016 | Yoneda et al. | B23P 19/027 |
| 9,278,540 | B2 | 3/2016 | Seki et al. | B41J 2/17513 |
| 9,375,938 | B2 | 6/2016 | Kondo et al. | B41J 2/17513 |
| 9,597,884 | B2 | 3/2017 | Nanjo et al. | B41J 2/17546 |
| 9,682,564 | B2 | 6/2017 | Saeki et al. | B41J 2/17506 |
| 2004/0012657 | A1 * | 1/2004 | Perkins | B41J 2/17513 347/86 |
| 2005/0068351 | A1 | 3/2005 | Katayama | 347/7 |
| 2005/0151764 | A1 * | 7/2005 | Grady | B41J 2/17509 347/7 |
| 2006/0124662 | A1 * | 6/2006 | Reynolds | A47K 5/1217 222/23 |
| 2011/0209335 | A1 | 9/2011 | Yamamoto et al. | 29/505 |
| 2012/0200646 | A1 | 8/2012 | Karasawa et al. | 347/86 |
| 2015/0343793 | A1 | 12/2015 | Takada et al. | B41J 2/17556 |
| 2015/0352851 | A1 | 12/2015 | Shiba et al. | B41J 2/17513 |
| 2016/0200114 | A1 | 7/2016 | Nanjo et al. | B41J 2/17546 |
| 2016/0318022 | A1 * | 11/2016 | Accurso | G01N 1/28 |
| 2016/0347078 | A1 | 12/2016 | Kato et al. | B41J 2/175 |
| 2016/0355021 | A1 * | 12/2016 | Kanbara | B41J 2/175 |
| 2017/0087863 | A1 | 3/2017 | Miyashita et al. | B41J 2/165 |
| 2017/0096010 | A1 | 4/2017 | Nanjo et al. | B41J 2/17546 |
| 2017/0120606 | A1 | 5/2017 | Koshikawa et al. | B41J 2/17509 |
| 2017/0120609 | A1 | 5/2017 | Kimura et al. | B41J 2/175 |
| 2017/0120613 | A1 | 5/2017 | Ikebe et al. | B41J 2/17513 |
| 2017/0136776 | A1 | 5/2017 | Shiba et al. | B41J 2002/17576 |
| 2017/0151797 | A1 | 6/2017 | Hayashi et al. | B41J 2/17566 |
| 2017/0151803 | A1 | 6/2017 | Yoshii et al. | B41J 2002/17576 |

FOREIGN PATENT DOCUMENTS

| | | |
|---|---|---|
| JP | 2003-305865 | 10/2003 |
| JP | 2005-104024 | 4/2005 |
| WO | WO2012/086171 | 6/2012 |

OTHER PUBLICATIONS

U.S. Appl. No. 15/489,445, filed Apr. 5, 2017.
U.S. Appl. No. 15/603,131, filed May 23, 2017.
U.S. Appl. No. 15/625,960, filed Jun. 16, 2017.
U.S. Appl. No. 15/479,816, filed Apr. 5, 2017.
JP Office Action dated Apr. 16, 2019 in counterpart JP Application No. 2016-098057 with English translation.

* cited by examiner

LIQUID EJECTING APPARATUS AND LIQUID REFILLING CONTAINER

BACKGROUND OF THE INVENTION

Field of the Invention

The present invention relates to a liquid refilling container from which a liquid is fed to a liquid ejecting portion and a liquid ejecting apparatus including the liquid refilling container.

Description of the Related Art

As a liquid ejecting apparatus that ejects a liquid for printing, an ink jet printing apparatus is known. In the ink jet printing apparatus, ink is ejected from a print head serving as a liquid ejecting portion to print a print medium. The ink is fed to the print head, for example, from an ink tank provided in the ink jet printing apparatus, via a channel.

An ink jet printing apparatus disclosed in Japanese Patent Laid-Open No. 2003-305865 is provided with a plurality of print heads to eject a plurality of types of ink and with a plurality of ink tanks corresponding to the print heads. To refill the ink tanks with ink, a user injects ink into an ink injection port formed in each of the ink tanks, through an ink refilling port in an ink refilling container. At this time, possible mis-injection needs to be prevented in which a type of ink different from the proper type of ink to be injected into the ink tank is injected. Thus, protrusions and holes forming a geometric shape are formed on each of a surface of the ink tank in which the ink injection port is formed and a member provided in an outer peripheral portion of the ink refilling container. Whether the ink in the ink refilling container and the ink to be fed into the ink tank are of the same type can be determined depending on whether the protrusions and holes formed on the surface of the ink tank fit the holes and protrusions formed on the ink refilling container.

However, in the configuration disclosed in Japanese Patent Laid-Open No. 2003-305865, the protrusions and holes on the ink refilling container are provided away from the ink refilling port. Thus, disadvantageously, the user needs to refill the ink tank with ink while checking a plurality of points such as the ink refilling port on the ink refilling container and the protrusions and holes on the ink refilling container, leading to a cumbersome check operation and the need for much time for the operation.

SUMMARY OF THE INVENTION

An object of the present invention is to provide a liquid ejecting apparatus that enables a liquid storage container to be properly and easily refilled with a liquid from a liquid refilling container without causing color mixture in the liquid storage container.

An aspect of the present invention provides a liquid ejecting apparatus including a liquid ejecting portion configured to eject a liquid, liquid storage containers each configured to store the liquid fed to the liquid ejecting portion, and liquid refilling containers each configured to refill the liquid storage container with the liquid. Each of the liquid storage containers has a liquid injection port through which the liquid is injected, a pressing member provided inside the liquid injection port, a first shape portion, and a second shape portion. Each of the liquid refilling containers has a liquid pour-out port through which the liquid is poured out, a sealing material configured to seal the liquid pour-out port, a third shape portion enabled to engage with the first shape portion, and a fourth shape portion enabled to engage with the second shape portion. In a case where the first shape portion engages with the third shape portion and the second shape portion engages with the fourth shape portion, the pressing member presses the sealing material to open the liquid pour-out port.

Another aspect of the present invention provides a liquid ejecting apparatus including a liquid ejecting portion configured to eject a liquid and liquid storage containers each configured to store the liquid fed to the liquid ejecting portion. The liquid ejecting apparatus allows the liquid storage containers to be refilled with the liquid from liquid refilling containers. Each of the liquid storage containers has a liquid injection port through which the liquid is injected, a pressing member provided inside the liquid injection port, a first shape portion, and a second shape portion. Each of the liquid refilling containers has a liquid pour-out port through which the liquid is poured out, a sealing material configured to seal the liquid pour-out port, a third shape portion enabled to engage with the first shape portion, and a fourth shape portion enabled to engage with the second shape portion in a case where the first shape portion engages with the third shape portion. In a case where the first shape portion engages with the third shape portion and the second shape portion engages with the fourth shape portion, the pressing member presses the sealing material to open the liquid pour-out port.

Yet another aspect of the present invention provides a liquid refilling container configured to refill a liquid storage container in a liquid ejecting apparatus with a liquid, the liquid ejecting apparatus including a liquid ejecting portion configured to eject the liquid, the liquid refilling containers, and the liquid storage containers each configured to store the liquid fed to the liquid ejecting portion. Each of the liquid storage containers has a liquid injection port through which the liquid is injected, a pressing member provided inside the liquid injection port, a first shape portion, and a second shape portion. Each of the liquid refilling containers has a liquid pour-out port through which the liquid is poured out, a sealing material configured to seal the liquid pour-out port, a third shape portion enabled to engage with the first shape portion, and a fourth shape portion enabled to engage with the second shape portion in a case where the first shape portion engages with the third shape portion. In a case where the first shape portion engages with the third shape portion and the second shape portion engages with the fourth shape portion, the pressing member presses the sealing material to open the liquid pour-out port.

The aspects of the present invention enables the liquid storage container to be properly and easily refilled with the liquid from the liquid refilling container without causing color mixture in the liquid storage container.

Further features of the present invention will become apparent from the following description of exemplary embodiments with reference to the attached drawings.

DESCRIPTION OF THE EMBODIMENTS

Embodiments of the present invention will be described below in detail with reference to the drawings.

First Embodiment

Figure 1:
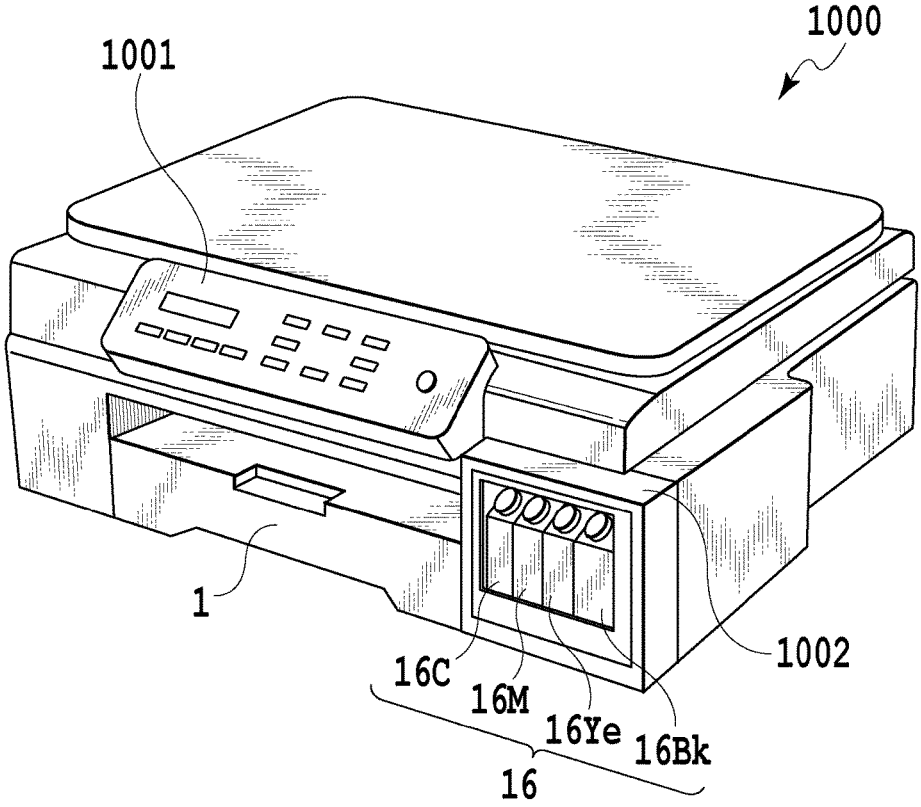
FIG. 1 is a perspective view illustrating a mechanical unit of an ink jet printing apparatus in an embodiment.
Figure 2:
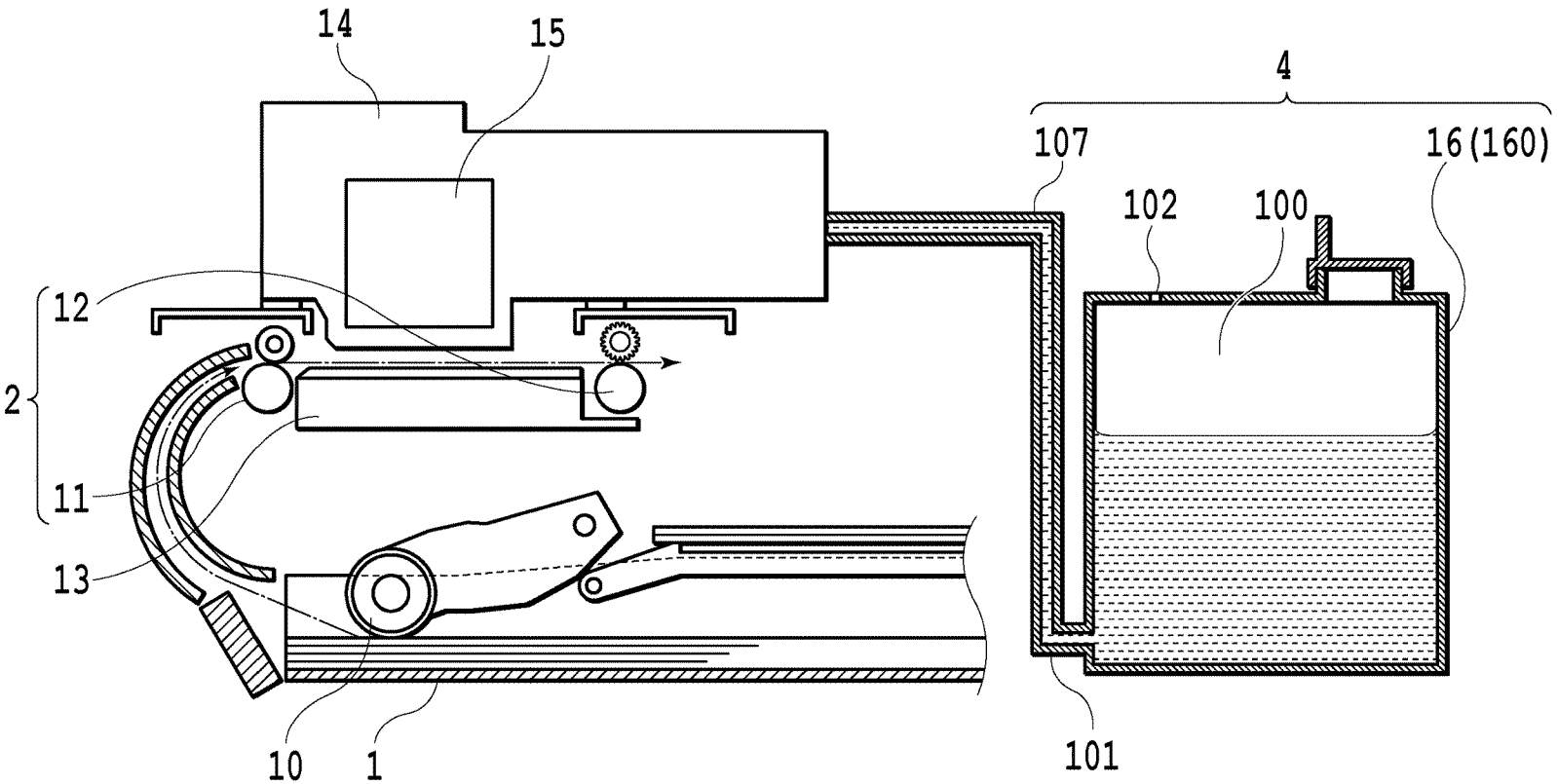
FIG. 2 is a longitudinal sectional view schematically illustrating a configuration of an essential part of the printing apparatus.

FIG. 1 is a perspective view illustrating a mechanical unit of an ink jet printing apparatus 1000 (hereinafter referred to as a printing apparatus) in an embodiment of the present invention. FIG. 2 is a longitudinal side view schematically illustrating a configuration of an essential part of the printing apparatus 1000. The mechanical unit mainly includes a first feeding unit 1, a second feeding unit 2, a printing unit 3, and a liquid supply unit 4. In the specification, "ink" is used as a general term for a liquid such as a printing liquid, a fixation treatment liquid, or a resist.

The first feeding unit 1 uses a feeding roller 10 to separate a print medium from a bundle of print media and feeds the print medium to the second feeding unit 2. The second feeding unit 2 is provided downstream of the first feeding unit 1 in a conveying direction to convey the print medium fed from the feeding roller 10, using a conveying roller 11, a discharging roller 12, and the like. A platen 13 that holds the print medium is provided between the conveying roller 11 and the discharging roller 12. The print medium conveyed by the second feeding unit is supported from below in the vertical direction by the platen 13.

The printing unit 3 includes a carriage 14 that reciprocates in a direction orthogonal to the conveying direction of the print medium in FIG. 2 and a print head 15 mounted in the carriage 15 and serving as a liquid injection unit. The print head 15 has an ink injection unit in which a plurality of ejection ports through which ink is ejected is arranged. Ejection energy generating elements are provided in the respective ejection ports included in the ink ejecting portion, and are driven based on print data to eject ink through the ejection ports to print an image on the print medium supported by the platen 13.

The ink supply unit 4 includes ink tanks 16 serving as liquid storage containers, ink channels 101 through each of which ink is guided from the corresponding ink tank 16 to the print head 15, and flexible ink supply tubes 107 each of which couples the corresponding ink channel 101 to the print head 15. In a case where a printing operation is performed by ejecting ink through the ejection ports in the print head 15, a negative pressure in the print head 15 increases. The increased negative pressure allows the ink stored in an ink storage chamber 100 in each of the ink tanks 16 to be fed to the print head 15 via the corresponding ink channel 101 and ink supply tube 107. At this time, air the amount of which is the same as the amount of the ink fed to the print head 15 flows into the ink tank 16 through an air communication port 102 formed on a vertically upper side of the ink tank 16.

Figure 3:
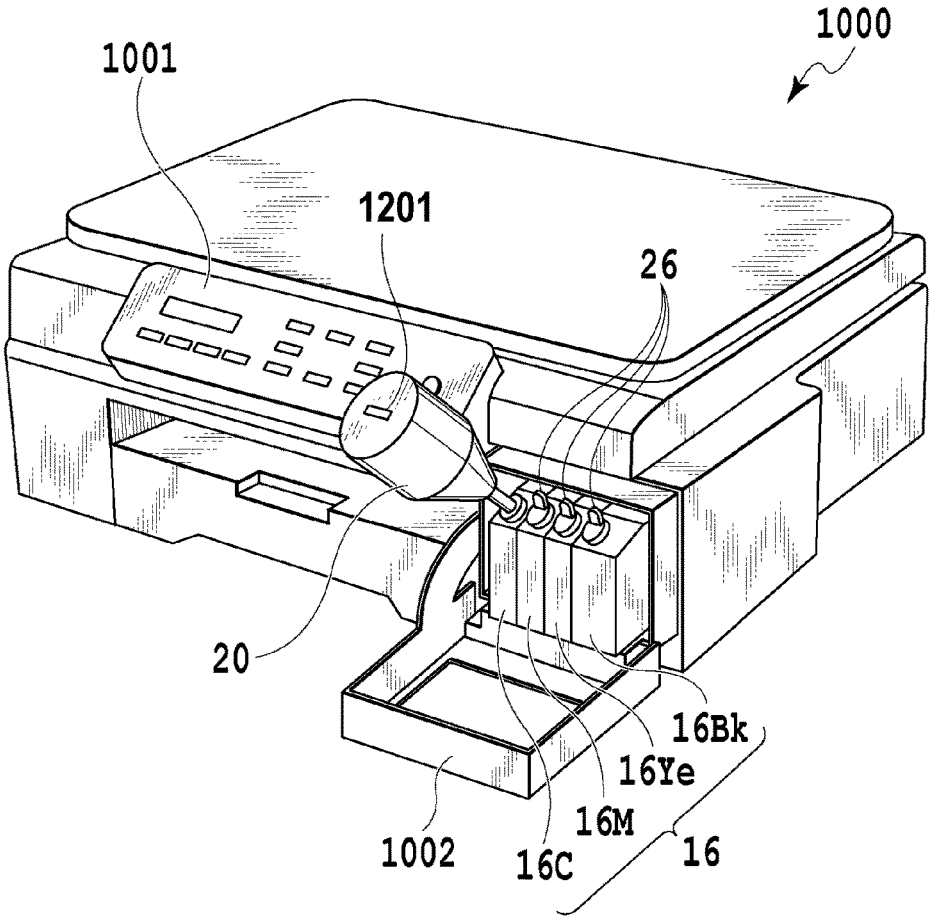
FIG. 3 is a perspective view illustrating that an ink tank is refilled with ink.
Figure 4:
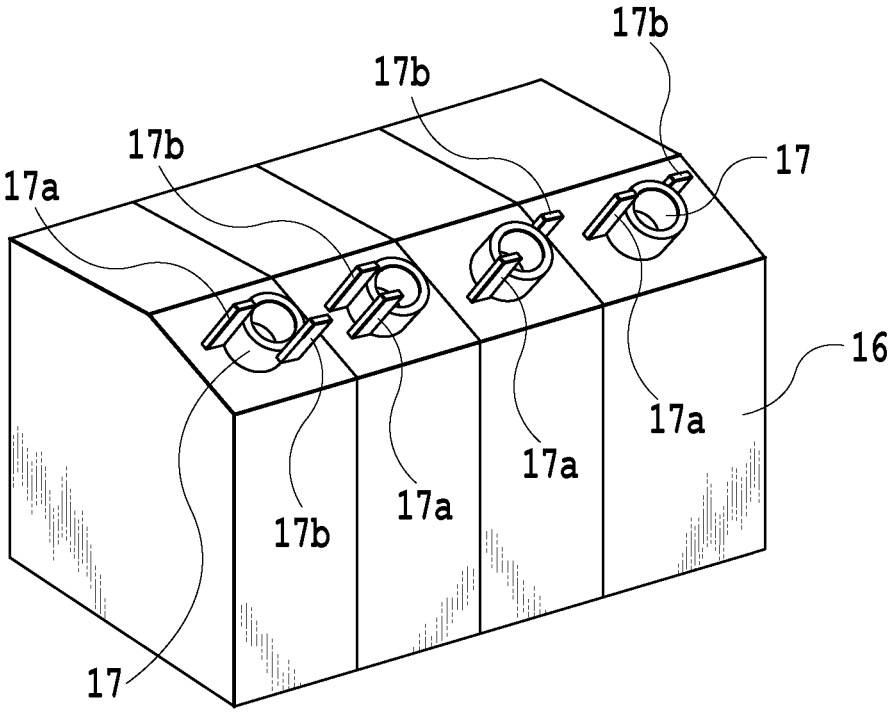
FIG. 4 is a perspective view illustrating a plurality of types of ink tanks in a first embodiment.

The printing apparatus 1000 is a color printer that ejects a plurality of types of ink in different colors to print color images on print media. Thus, the print head 15 is provided with a plurality of ink ejecting portions corresponding to the plurality of types of ink. In the present embodiment, four ink ejecting portions are provided which eject ink in four colors of yellow, cyan, magenta, and black. As illustrated in FIG. 3 and FIG. 4, four types of ink tanks 16 in which the respective types of ink are housed are provided in the respective ink ejecting portions. In the description below, a generic reference numeral 16 is used to collectively refer to the four ink tanks, and the following different reference numerals are used to discretely refer to the four ink tanks. That is, the ink tank that stores a cyan ink is designated as 16C, the ink tank that stores a magenta ink is designated as 16M, the ink tank that stores a yellow ink is designated as 16Ye, and the ink tank that stores a black ink is designated as 16Bk.

For the ink tanks 16C, 16M, 16Ye, 16Bk, in a case where the amount of remaining ink is equal to or smaller than a predetermined value, this is indicated on a display unit 1001 of the printing apparatus to urge a user to refill, with ink, the ink tank 16 with an insufficient amount of remaining ink. In a case where each of the ink tanks 16 is refilled with ink, first, the user opens a tank cover 1002 provided on a front surface of the printing apparatus 1000 and removes a cap 26 provided on the ink tank 16 to expose an ink injection port (liquid injection port) 18 (see FIG. 6B) as illustrated in FIG. 3. Then, the ink tank 16 is refilled with the ink through the exposed ink injection unit 18.

The ink tank 16 is refilled with the ink by the user using an ink refilling container (liquid refilling container) 20 in which ink is stored. Thus, the number of ink refilling containers 20 prepared corresponds to the number of colors of the ink used (in the present invention, four colors). In a refilling operation, based on color information displayed on the ink tanks 16 and the ink refilling containers 20, the user makes determination to select the ink refilling container 20 and feeds ink into the ink injection port 18 in the ink tank 16. At this time, in a case where the ink refilling container 20 is selected which stores ink not to be delivered to the ink tank 16, and the ink tank 16 is refilled with the ink, the color of the provided ink mixes with the color of the ink remaining in the ink tank 16. The ink with the mixed colors is fed to the print head 15. To avoid such mis-injection of ink into the ink tank 16, the present embodiment provides the liquid supply unit including the ink tank 16 and the ink refilling container 20 as described below.

FIG. 4 is a perspective view illustrating a configuration of the ink tanks 16 in a first embodiment. As illustrated in FIG. 4, each of the ink tanks 16C, 16M, 16Ye, 16Bk has a cylindrical mouth portion 17 provided around the ink injection port 18 so as to protrude therefrom. The mouth portion 17 is provided with two protruding portions 17*a*, 17*b* protruding outward and extending in an axial direction of the mouth portion 17. The combination of formation positions of the protruding portions 17*a*, 17*b* varies depending on the ink tank. The mouth portion 17 and the protruding portions 17*a*, 17*b* form a first fitting unit.

Figure 5:
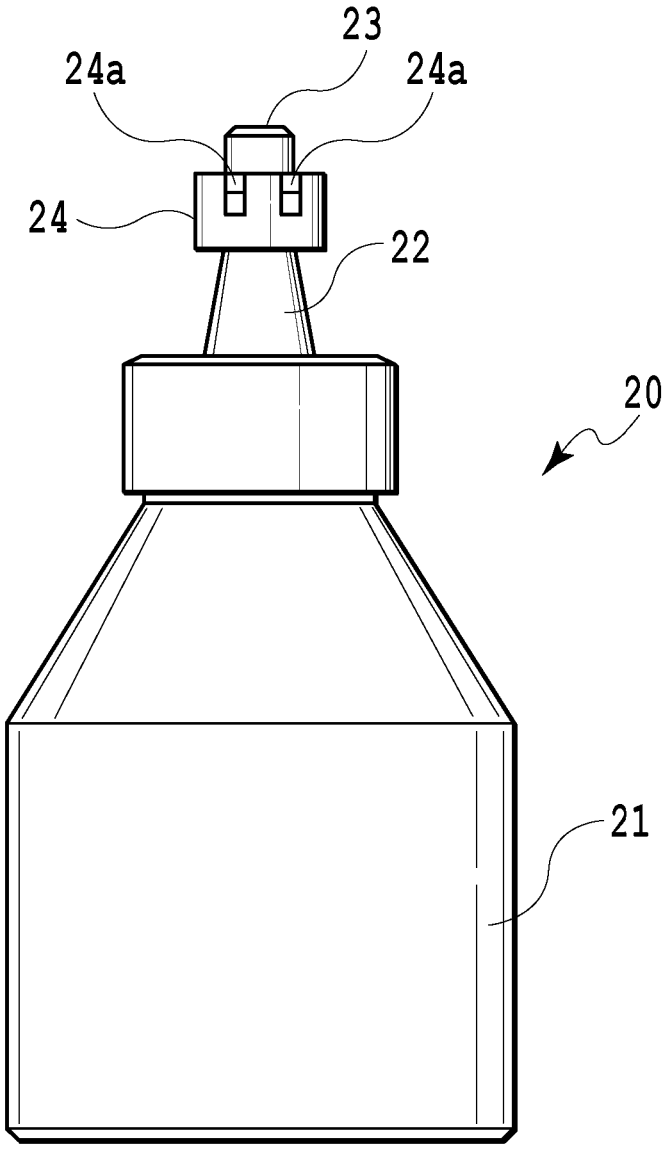
FIG. 5 is a side view illustrating an ink refilling container in the first embodiment.

FIG. 5 is a side view illustrating one of the ink refilling containers 29 used in the present embodiment. As described above, four types of ink refilling containers 20 are prepared for the respective stored inks. Each ink refilling container 20 has a main body portion 21 continuous with a bottom portion and a nozzle portion 22 having a smaller diameter than the main body portion 21. At a first end of the nozzle portion 22, an ink pour-out port (liquid pour-out port) 23 is formed through which the ink stored inside the ink refilling container 20 is poured out.

The ink injection port 18 in the ink tank 16 is formed to have such a size and a shape as to allow the first end (tip) of the nozzle portion 22 forming the ink pour-out port 23 to be loosely inserted into the ink injection port 18. The ink is fed to the ink tank 16 through the ink refilling container 20 with the tip of the nozzle portion 22 of the ink refilling container 20 inserted into the ink injection port 18 (see FIG. 6B) of the ink tank 16.

An annular portion 24 that is open at a first end thereof is formed on an outer peripheral surface of a middle portion of the nozzle portion 22. The annular portion 24 is provided with two recessed portion (first shape portion) 24*a* and recessed portion (second shape portion) 24*b* extending inward from an opening edge of the annular portion 24. Each of the two recessed portions 24*a*, 24*b* has such a width and a depth as to allow the corresponding one of the protruding portions 17*a*, 17*b* provided on the mouth portion 17 of the ink tank 16 to be inserted into the recessed portion. The combination of formation positions of the recessed portions 24*a*, 24*b* varies depending on the type of the ink stored in the ink tank 16.

Figure 6B:
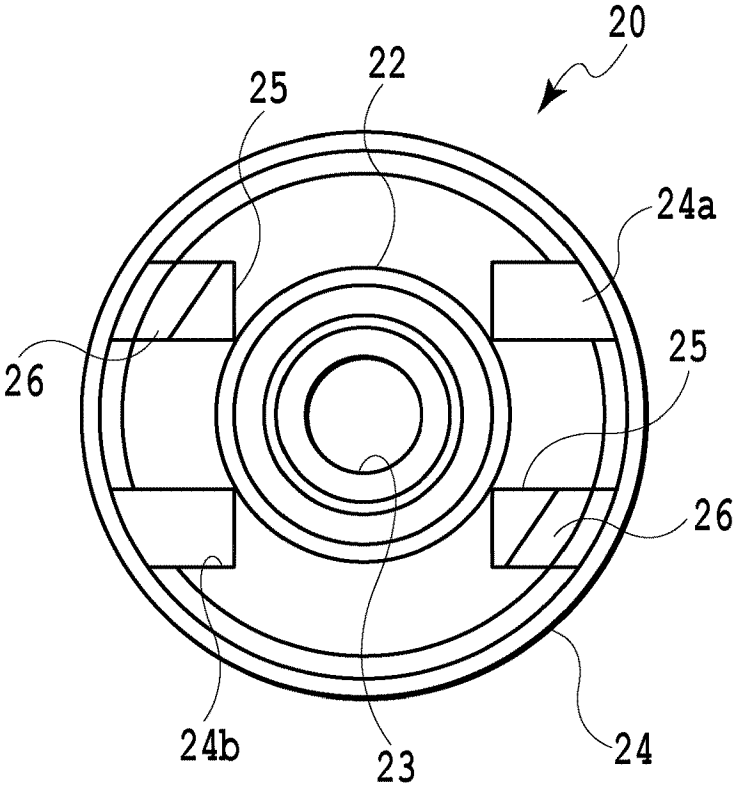
FIG. 6B is a plan view illustrating a peripheral configuration of an ink pour-out port in an ink refilling container in the first embodiment.
Figure 6A:
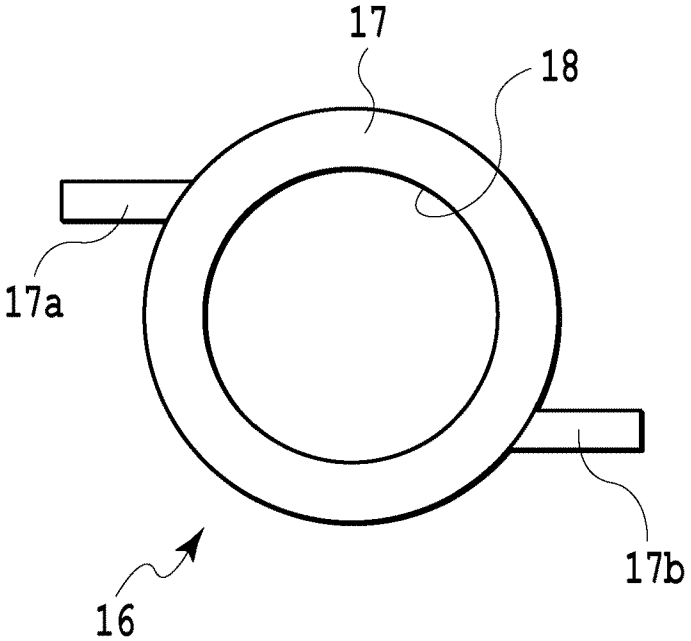
FIG. 6A is a plan view illustrating a peripheral configuration of an ink ejection port in the ink tank in the first embodiment.

FIG. 6A is a plan view illustrating the protruding portions 17*a*, 17*b* formed on the mouth portion 17 of the ink tank 16. FIG. 6B is a plan view illustrating a cylindrical portion 24 of the ink refilling container 20 in which the ink to be delivered to the ink tank 16 illustrated in FIG. 6A is stored. As illustrated in FIG. 6A, the recessed portions 24*a*, 24*b* are formed in the cylindrical portion 24 of the ink refilling container 20 at positions corresponding to the protruding portions 17*a*, 17*b*. Thus, in a case where the ink pour-out port 23 of the ink refilling container 20 is directed toward and inserted into the ink injection port 18 in the ink tank 16, the recessed portions 24*a*, 24*b* can be fitted over the protruding portions 17*a*, 17*b*, respectively, of the ink tank 16. Therefore, the ink pour-out port 23 of the ink refilling container 20 can be inserted inward with respect to the ink injection port 18 in the ink tank 16.

In a case where the recessed portions 24*a*, 24*b* of the ink refilling container 20 used are formed at positions different from the positions illustrated in FIG. 6B, the recessed portions 24*a*, 24*b* fail to be fitted over the protruding portions 17*a*, 17*b* of the ink tank 16. Thus, the ink pour-out port 23 of the ink refilling container 20 fails to be inserted into the ink injection port 18 in the ink tank 16. In this state, the ink tank 16 is inhibited from being properly refilled with the ink in the ink refilling container 20. The cylindrical portion 24 and the recessed portions 24*a*, 24*b* formed in the cylindrical portion 24 form a second fitting unit.

As described above, whether or not the ink to be delivered to the ink tank 16 matches the ink in the ink refilling container 20 can be checked depending on whether or not the protruding portions 17*a*, 17*b* of the ink tank 16 are successfully fitted into the recessed portions 24*a*, 24*b* of the ink refilling container 20. In a case where a success in fitting the protruding portions 17*a*, 17*b* into the recessed portions 24*a*, 24*b* is confirmed, the ink refilling container 20 is temporarily taken out, the sealing material sealing the ink pour-out port 23 is peeled off, and the ink refilling container 20 is inserted back into the ink tank 16. In a case where a failure in fitting the protruding portions 17*a*, 17*b* into the recessed portions 24*a*, 24*b* is confirmed, the ink refilling container 20 is changed to another proper one. Consequently, possible mis-injection of ink into the ink tank 16 can be prevented.

As described above, the ink injection port 18 in the ink tank 16 is formed to have a sufficiently larger size and a sufficiently shape than the first end of the nozzle portion 22 that is inserted into the ink injection port 18. Thus, in a case where the ink tank 16 is refilled with ink, air in the ink tank 16 can be expelled through a gap formed between the opening 18 in the ink tank 16 and the first end of the nozzle portion 22, allowing the gas and the liquid to be smoothly exchanged with each other inside the ink tank 16.

In a case where four types of ink are used, four types of ink tanks 16 and four types of ink refilling containers 20 need to be prepared. In a case where four types of ink tanks 16 are prepared, the protruding portions 17*a*, 17*b* may be integrally formed at preset four positions on a peripheral surface of each ink tank 16, and the protruding portions 17*a*, 17*b* at two positions may be removed which correspond to the type of the ink to be stored. On the other hand, in the ink refilling container 20, in a case where the recessed portions 24*a*, 24*b* are formed only at two positions corresponding to the formation positions of the protruding portions 17*a*, 17*b* of the ink tank 16, the ink refilling containers 20 need to be formed using four types of molding portions (for example, molds). This increases costs. Thus, the present embodiment adopts such a manufacturing method as includes integrally forming common ink refilling containers 20, and after types of ink to be stored are determined, executing additional machining in a manufacturing stage to form recessed portions 24*a*, 24*b* at formation positions corresponding to the type of the ink. This allows the use of a common molding portion (for example, a mold), enabling a reduction in costs. Specifically, as illustrated in FIG. 6B, the same molding portion is used to integrally mold ink refilling containers 20 each having recessed portions 25 and beam portions 26 each of which partly fills the inside of the recessed portion 25 and each of which is easily removable. After the type of the ink to be stored is determined, the beam portions 26 at needed two portions are cut off or removed on heating to form the recessed portions 24*a*, 24*b*. This allows the use of the same molding portion and also allows four types of ink refilling containers 20 to be obtained by an easy additional machining process, enabling a reduction in costs.

Also in a case where the main body portion and the mouth portion 17 of the ink tank are separately formed, the mouth portion 17 is preformed to have the protruding portions at four positions and unwanted protruding portions are removed depending on the type of the ink as described above. This enables a reduction in the cost of the molding portion and thus in manufacturing costs.

Second Embodiment

In the first embodiment, even in a case where the protruding portions of the ink tank 16 are not fitted into the recessed portions of the ink refilling container 20, the sealing material may be peeled off from the ink pour-out port 23 in the ink refilling container 20, and the ink tank 16 may be forcibly refilled with ink that is incompatible with the ink tank 16. Thus, a liquid ejecting apparatus in a second embodiment is configured such that ink is not injected into the ink tank 16 unless the recessed portions 24*a*, 24*b* of the ink refilling container 20 are fitted over the protruding portions 17*a*, 17*b* of the ink tank 16.

Figure 7B:
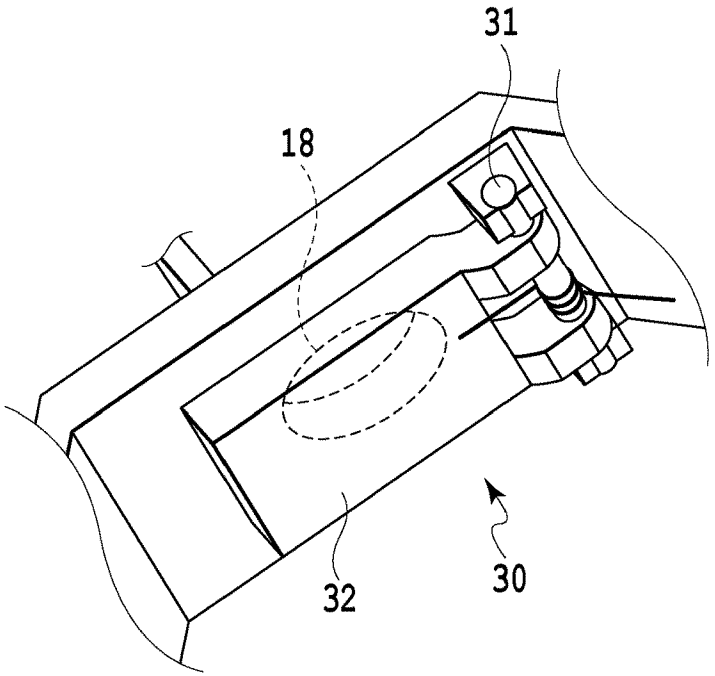
FIGS. 7A and 7B are perspective views illustrating characteristic portions in a second embodiment.
Figure 7A:
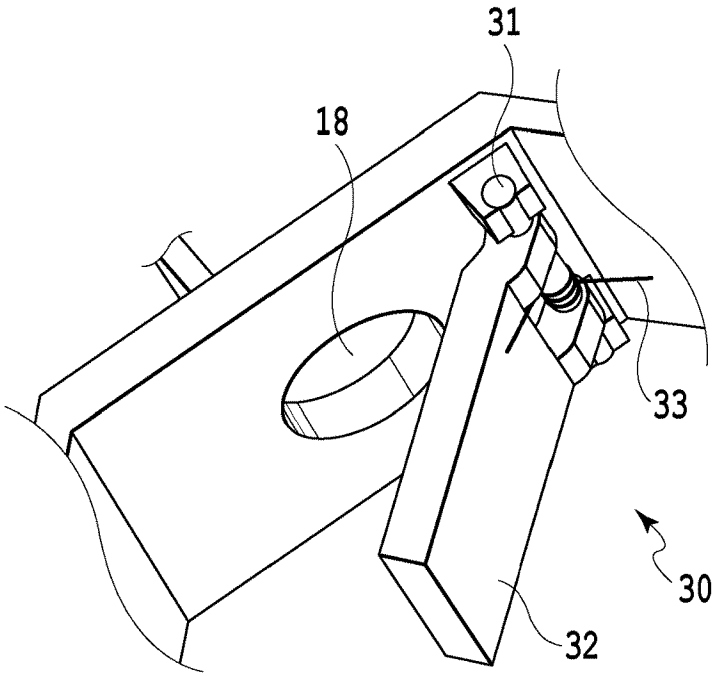
Figure 8B:
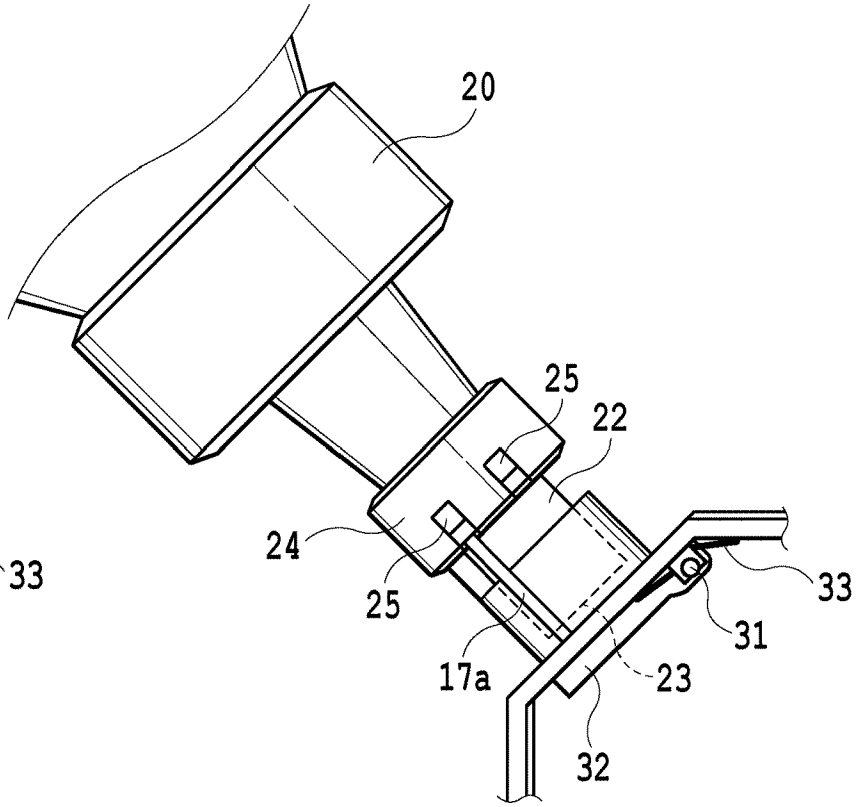
FIGS. 8A and 8B are diagrams illustrating a part of a liquid supply unit including the portions illustrated in FIGS. 7A and 7B and illustrating operations of the liquid supply unit.
Figure 8A:
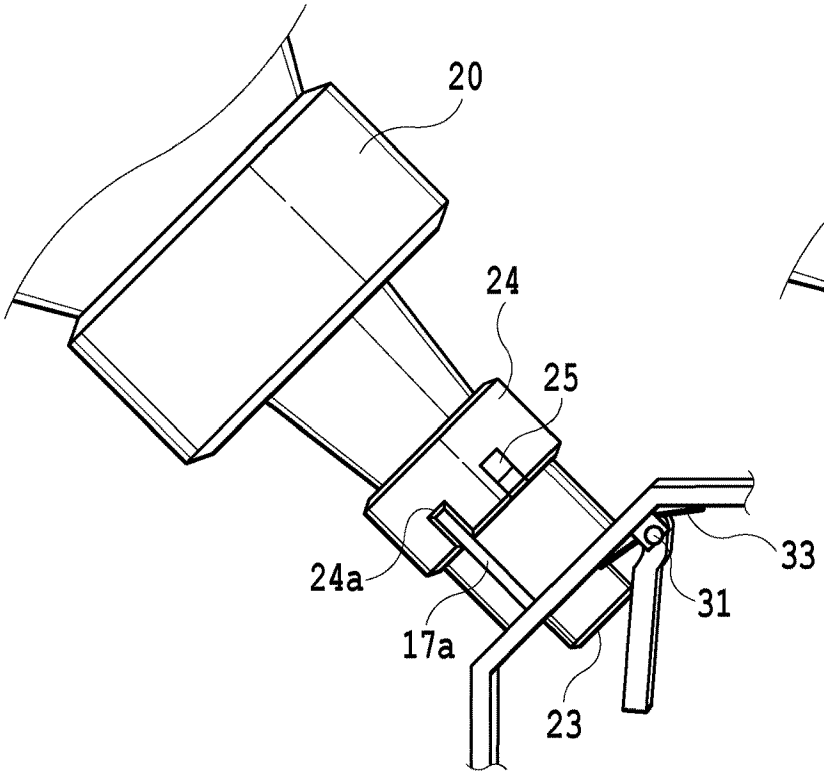

FIG. 7A and FIG. 7B are perspective views illustrating characteristic portions of the second embodiment. FIG. 8A and FIG. 8B are diagrams illustrating operations of a part of the liquid ejecting apparatus including the portions illustrated in FIG. 7A and FIG. 7B. In the figures, the same portions as those in the first embodiment or portions corresponding to particular portions in the first embodiment are denoted by the same reference numerals and will not be described in detail. As illustrated in FIG. 7A and FIG. 7B, an on-off valve 30 that can open and close the ink injection port 18 is provided inside the ink tank 16. The on/off valve 30 includes an opening/closing plate (opening/closing member) 32 supported at a first end thereof by a support shaft 31 so as to pivot freely, and a coil spring 33 that biases the opening/closing plate 32. The opening/closing plate 32 is biased by the coil spring 33 so as to closely contact an inner surface of the ink tank 16 as illustrated in FIG. 7A. The opening/closing plate 32 closely contacts the inner surface of the ink tank 16 to block ink flowing in through the ink injection port 18.

In a case where the ink tank 16 is refilled with ink using the ink refilling container 20 in which the ink to be delivered to the ink tank 16 is stored, the recessed portions 24*a*, 24*b* of the ink refilling container 20 are fitted over the protruding portions 17*a*, 17*b* of the ink tank 16 as illustrated in FIG. 8A. At this time, the tip of the nozzle portion 22 of the ink refilling container 20 pushes open the opening/closing plate 32 occluding the ink injection port 18 against a bias force of the coil spring 33, and the ink pour-out port 23 formed at the tip of the nozzle portion 22 is positioned inside the ink tank 16. Consequently, the ink in the ink refilling container 20 is delivered into the ink tank 16 through the ink pour-out port 23.

In a case where the ink refilling container 20 is used in which ink incompatible with the ink tank 16 is stored, the recessed portions 24*a*, 24*b* of the ink refilling container 20 fail to be fitted over the protruding portions 17*a*, 17*b* of the ink tank 16. Thus, the tip of the nozzle portion 22 fails to come into contact with the opening/closing plate 32, which remains occluding the ink pour-out port 23, as illustrated in FIG. 8B. Therefore, even in a case where the ink is allowed to flow out through the ink pour-out port 23 in the ink refilling container 20, the ink tank 16 is inhibited from being refilled with the ink, allowing prevention of mixture of different types of ink in the ink tank 16.

The length of the nozzle portion 22 and the depth of the recessed portions 24*a*, 24*b* may be set as needed such that the on/off valve 30 occludes the ink injection port 18 in a case where the protruding portions 17*a*, 17*b* fail to be fitted into the recessed portions 24*a*, 24*b* and opens the ink injection port in a case where the protruding portions 17*a*, 17*b* are successfully fitted into the recessed portions 24*a*, 24*b*. In a case where a member such as rubber is arranged around the opening/closing plate 32 or the ink injection port 18, closure of the ink injection port 18 by the opening/closing plate 32 is enhanced, enabling omission of the cap 26 configured to close the ink injection port 18.

Third Embodiment

Figure 9:
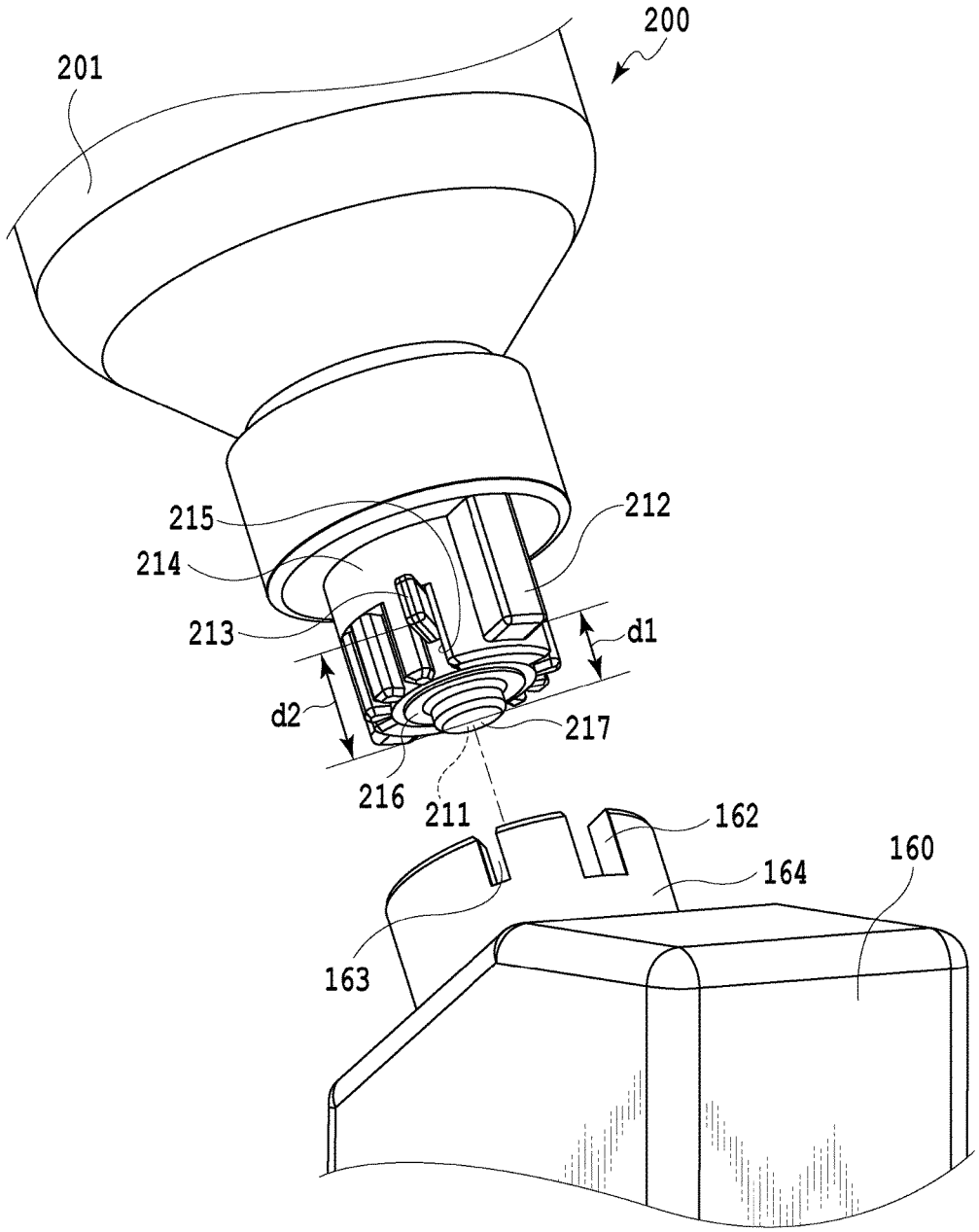
FIG. 9 is a perspective view illustrating a liquid supply unit in a third embodiment.
Figure 10B:
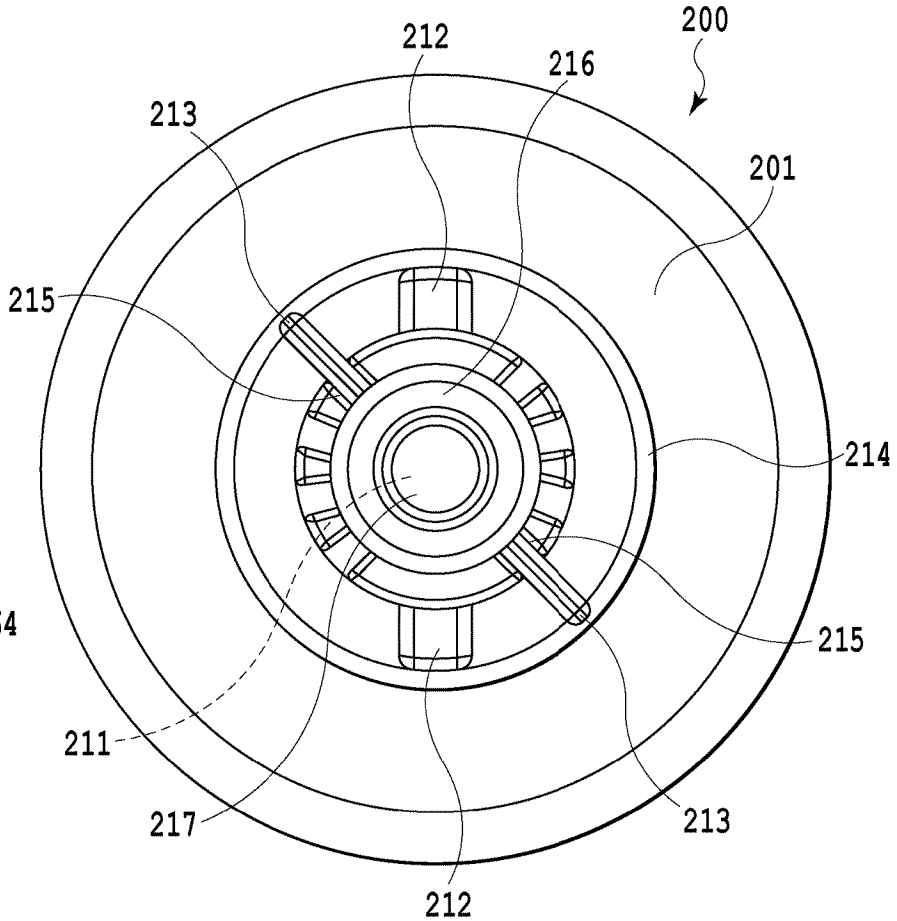
FIG. 10B is a plan view illustrating an ink refilling container illustrated in FIG. 9.
Figure 10A:
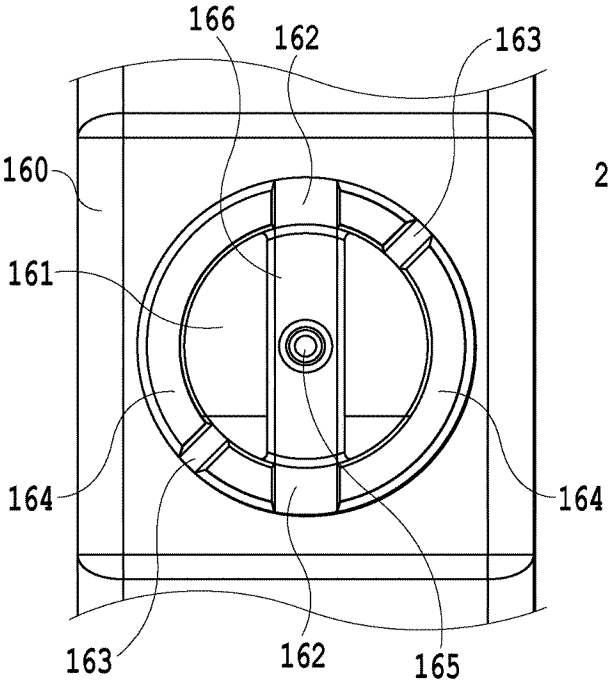
FIG. 10A is a plan view illustrating a part of an ink tank illustrated in FIG. 9.
Figure 11:
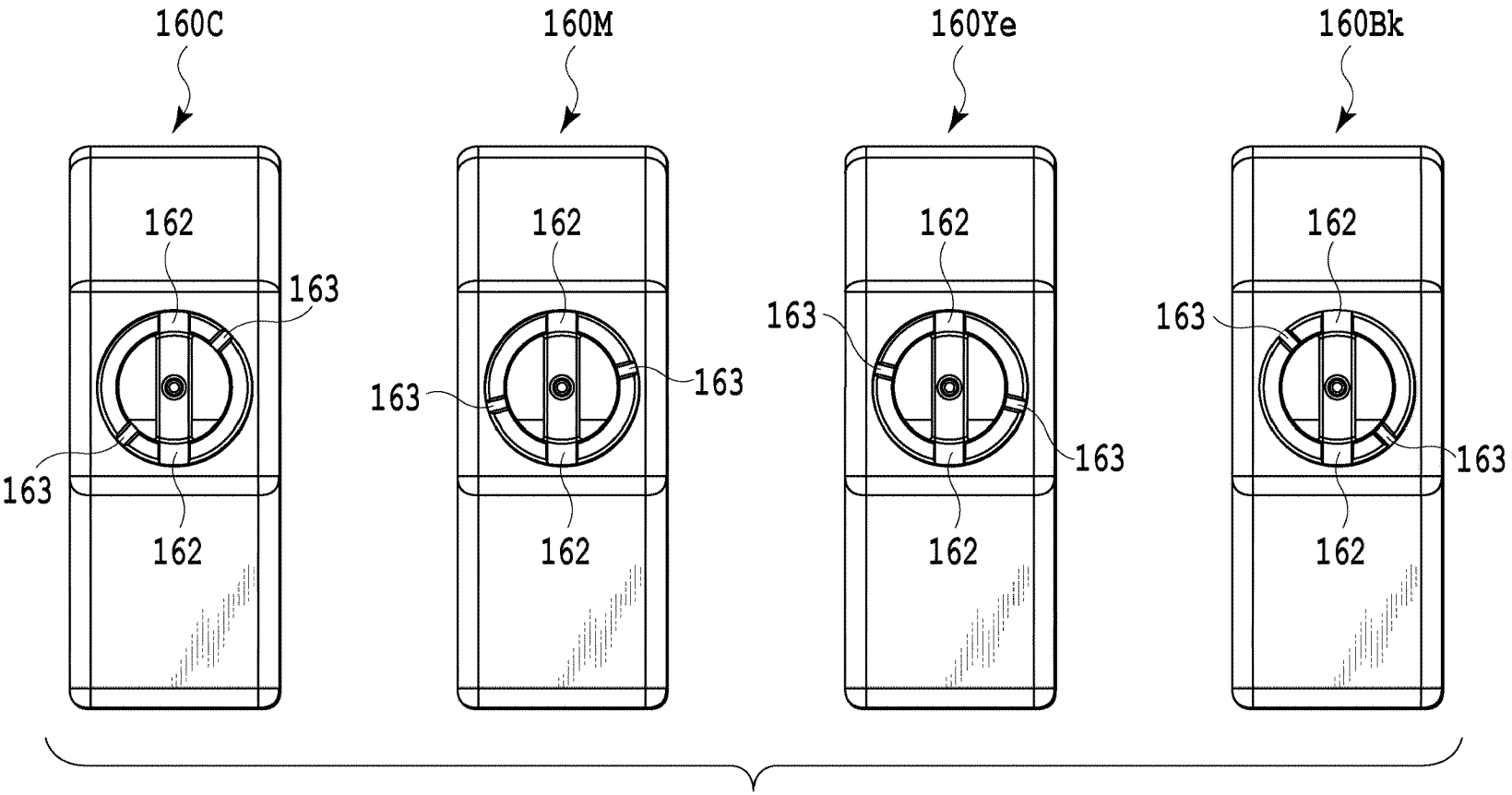
FIG. 11 is a plan view illustrating a plurality of types of ink tanks in a third embodiment.
Figure 12:
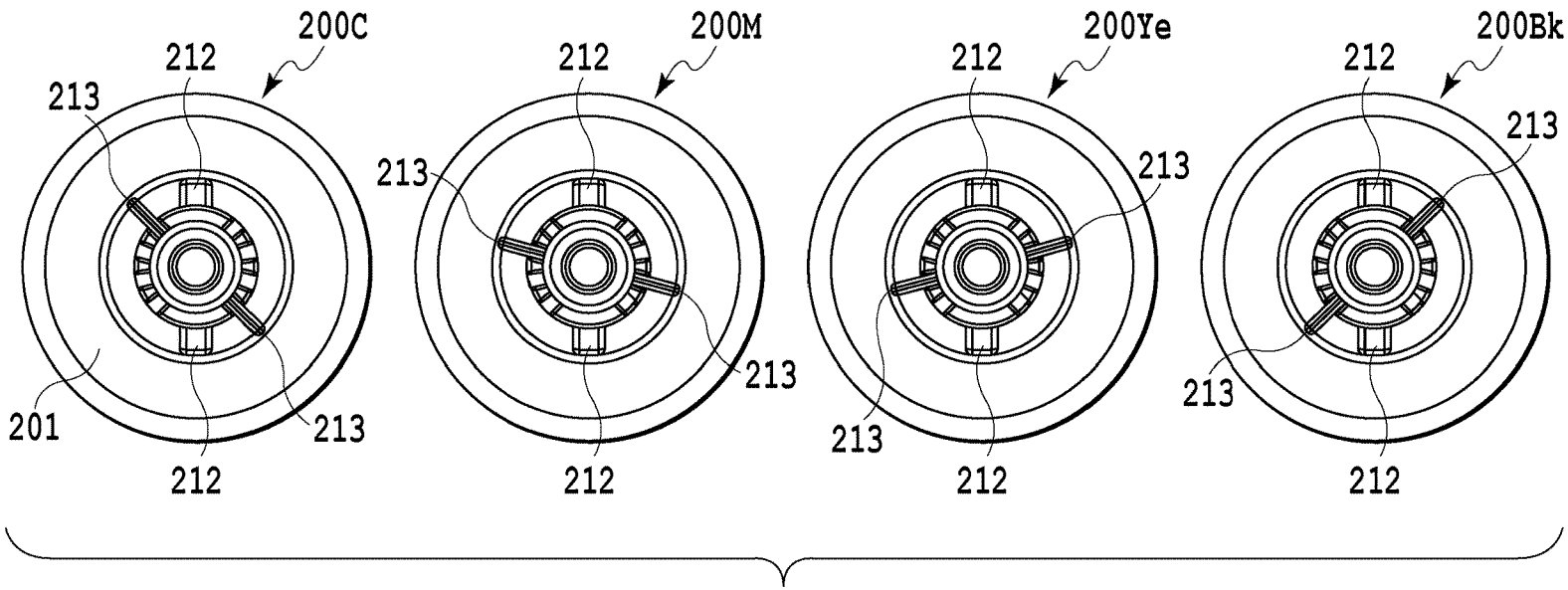
FIG. 12 is a plan view illustrating a plurality of types of ink refilling containers in a third embodiment.

Now, a third embodiment of the liquid ejecting apparatus according to the present invention will be described with reference to FIGS. 9 to 15A and 15B. FIG. 9 is a perspective view illustrating the liquid ejecting apparatus in the third embodiment. FIG. 10A is a plan view illustrating a part of an ink tank serving as an ink storage container. FIG. 10B is a plan view illustrating a part of an ink refilling container serving as a liquid refilling container. FIG. 11 is a plan view illustrating a plurality of types of ink tanks. FIG. 12 is a plan view illustrating a plurality of types of ink refilling containers.

The liquid ejecting apparatus in the present embodiment includes an ink tank 160 and an ink refilling container 200 illustrated in FIG. 9. Also in the third embodiment, ink stored in a liquid storage space in the ink tank 160 is fed to the print head 15 via the ink channel 101 and the ink supply tube 107 as in the case of the first embodiment (see FIG. 2).

As illustrated in FIG. 10A, the ink tank 160 is provided with an ink injection port 161, and a cylindrical mouth portion 164 protruding outward from an outer surface of the ink tank 160 is formed around the ink injection port 161. The mouth portion 164 is provided with first grooves (first shape portions) 162 extending along a direction parallel to a central axis of the mouth portion 164 and serving as recessed portions and second grooves (second shape portions) 163 also extending along the direction parallel to the central axis of the mouth portion 164 and serving as recessed portions. The width of each of the second grooves 163 is smaller than the width of each of the first grooves 162 in a circumferential direction of the ink injection port 161. The length (depth) of the second groove 163 is smaller than the length of the first groove 162.

In the present embodiment, two first grooves 162 and two second grooves 163 are formed, and the two first grooves 162 are formed at the respective positions on the same diameter of the mouth portion 164. Similarly, the two second grooves 163 are formed at the respective positions on the same diameter of the mouth portion 164. A support portion 166 is provided inside the ink injection port 161 and has a boss 165 serving as a pressing member. The boss 165 is positioned in a central portion of the ink injection port 164. The first grooves 162 and the second grooves 163 form a first fitting unit.

As illustrated in FIG. 11, the positions of the second grooves 163 with respect to the positions of the first grooves 162 in the ink tank 160 vary depending on the type of the ink to be stored. In FIG. 11, an ink tank 160C stores a cyan ink, an ink tank 160M stores a magenta ink, an ink tank 160Ye stores a yellow ink, and an ink tank 160Bk stores a black ink. The first grooves 162 are formed at the same positions on all the ink tanks 160. In the description below, a generic reference numeral 160 is used to collectively refer to the four ink tanks, and the above-described different reference numerals are used to discretely refer to the four ink tanks.

Now, a configuration of the ink refilling container 200 in the present embodiment will be described. As illustrated in FIG. 10B, the ink refilling container 200 is provided with a circular ink pour-out port 211 in an inner cylindrical portion 216 described below. As illustrated in FIG. 10B and FIG. 12, a cylindrical portion 214 projecting outward from an outer surface of the ink refilling container 200 is provided around the ink pour-out port 211. Two first protruding portions (third shape portions) 212 protruding outward are provided on an outer peripheral surface of the cylindrical portion 214. The two first protruding portions 212 are positioned at the respective positions on the same diameter of the cylindrical portion 214. Each of the first protruding portions 212 extends in a direction parallel to a central axis of the cylindrical portion 214 and has a slightly smaller width than each of the first grooves 162 in the ink tank 160 in a circumferential direction of the cylindrical portion 214. Thus, the first protruding portions 212 can be smoothly fitted into the first grooves 162 but fail to be fitted into the second grooves 163.

The inner cylindrical portion 216 having a smaller diameter than the cylindrical portion 214 is provided inside the cylindrical portion 214. On an outer peripheral surface of the inner cylindrical portion 216, two second protruding portions (four shape portions) 213 protruding outward are provided, and the ink pour-out port 211 is formed. The two second protruding portions 213 are located at the respective positions on the same diameter of the inner cylindrical portion 216, and inserted through cutout portions 215 formed in the cylindrical portion 214 so as to protrude outward from an outer peripheral surface of the cylindrical portion 214. The second protruding portions 213 extend in the direction parallel to the central axis of the cylindrical portion 214. Each of the second protruding portions 213 has a slightly smaller width than each of the second grooves 162 in the ink tank 160 in the circumferential direction of the cylindrical portion 214 so that the second protruding portions 213 can be smoothly fitted into the second grooves 163. Therefore, the second protruding portion 213 is smaller in width than the first protruding portion 212. In a direction of a central axis of the ink pour-out port 211, a distance d1 from an end of the second protruding portion 213 to the ink pour-out port 211 is smaller than a distance d2 from a tip of the first protruding portion 212 to the ink pour-out port 211. In other words, the second protruding portion 213 is provided farther away from the ink pour-out port 211 than the first protruding portion 212.

The ink pour-out port 211 is sealed with an elastic film (sealing material) 217 to allow the ink inside the ink refilling container 200 to be inhibited from flowing out even in a case where the ink pour-out port 211 of the ink refilling container 200 is directed downward.

As illustrated in FIG. 12, the formation positions of the second protruding portions 213 with respect to the formation positions of the first protruding portions 212 vary depending on the type of the ink stored inside the ink tank. In FIG. 12, an ink refilling container 200C stores a cyan ink, an ink refilling container 200M stores a magenta ink, an ink refilling container 200Ye stores a yellow ink, and an ink refilling container 200Bk stores a black ink. In the description below, a generic reference numeral 200 is used to collectively refer to the four ink refilling containers, and the above-described different reference numerals are used to discretely refer to the four ink refilling containers.

The first protruding portions 212 and second protruding portions 213 of the ink refilling container 200 are simultaneously fitted into the first grooves 162 and second grooves 163, respectively, in the ink tank 160 only in a case where the ink stored inside the ink refilling container 200 is of the same type as that of the ink to be stored in the ink tank 160. The first protruding portions 212 and the second protruding portions 213 form a second fitting unit.

In the third embodiment, the cylindrical portion 214 with the cutout portions 215 formed at four positions of the cylindrical portion 214 is formed integrally with the main body portion 201, whereas the inner cylindrical portion 216 is formed separately from the cylindrical portion 214. The above-described ink refilling container 200 is constructed by fixedly inserting the inner cylindrical portion 216 into the cylindrical portion 214. In a case where the inner cylindrical portion 216 is inserted into the cylindrical portion 214, the different ink refilling containers 200 can be constructed depending on the type of the stored ink by varying the positions of the cutout portions 215 through which the second protruding portions are inserted. Thus, compared to a case where the ink refilling containers 200 are integrally formed using different molding portions (for example, molds) for the respective types of ink, the present embodiment enables a reduction in the number of molding portions and simplification of the molding portions. This enables a reduction in manufacturing costs. However, the ink refilling container 200 as a whole can be integrally formed.

Figure 13C:
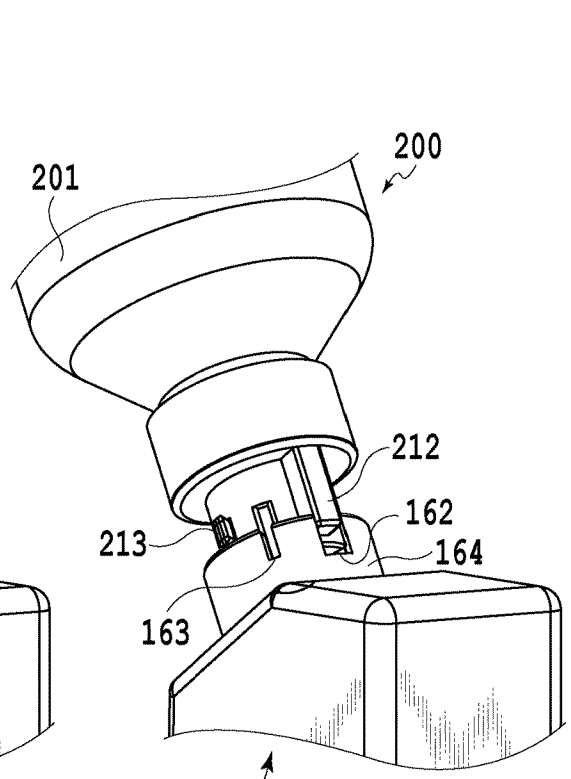
FIGS. 13A to 13C are perspective views illustrating an ink refilling operation in the third embodiment.
Figure 13B:
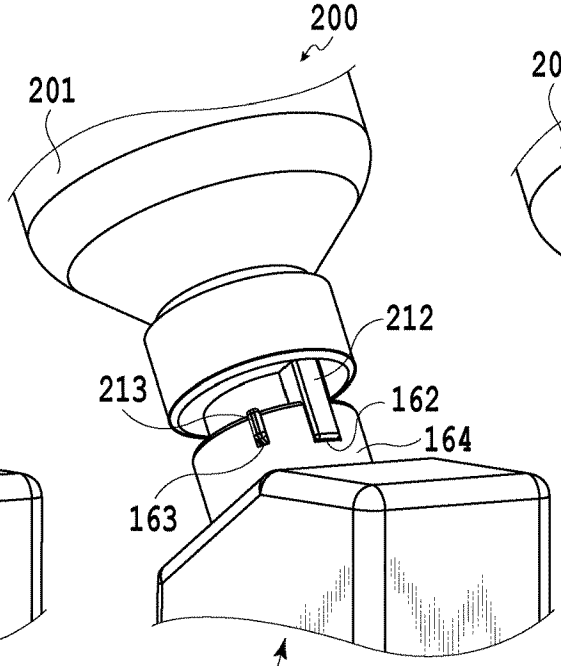
Figure 13A:
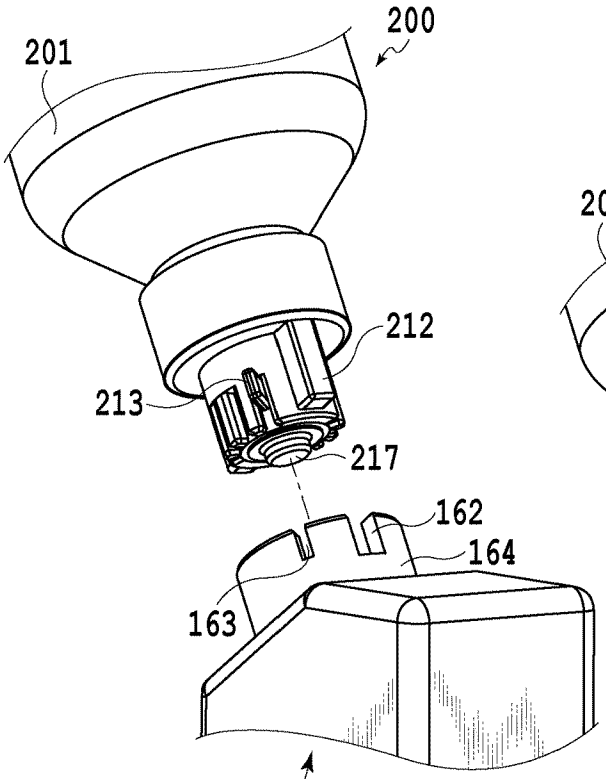
Figure 14C:
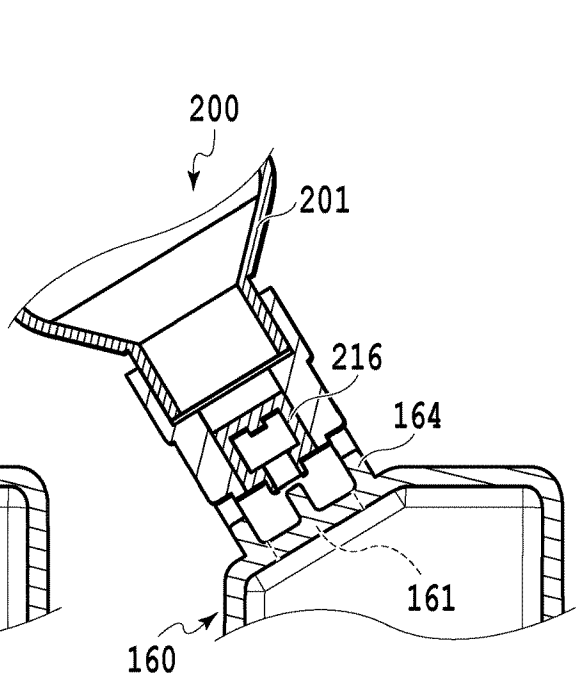
FIGS. 14A to 14C are longitudinal side views of portions illustrated in FIGS. 13A to 13C.
Figure 14B:
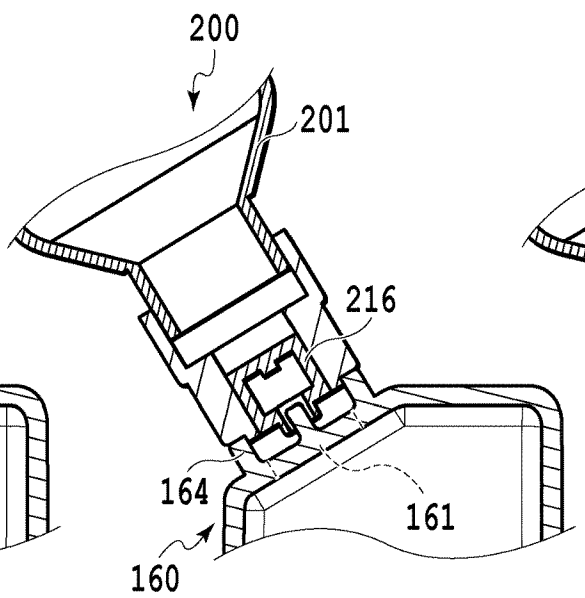
Figure 14A:
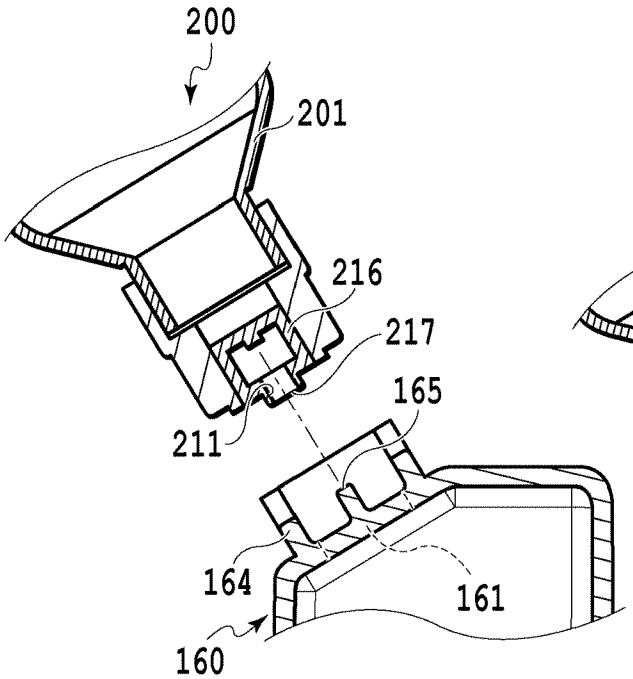

Now, an ink refilling operation will be described with reference to FIGS. 13A to 15A and 15B. FIG. 13A is a perspective view illustrating the ink tank 160 and the ink refilling container 200 before ink refilling. FIG. 14A illustrates sections of the ink tank 160 and the ink refilling container 200 in this case. FIG. 13B is a perspective view illustrating that the user is refilling the ink tank 160 with ink using the ink refilling container 200. FIG. 14B illustrates sections of the ink tank 160 and the ink refilling container 200 in this case. FIG. 13C is a perspective view illustrating the state of the ink tank 160 and the ink refilling container 200 in a case where the type of the ink to be delivered to the ink tank 160 fails to match the type of the ink stored in the ink refilling container 200. FIG. 14C illustrates sections of the ink tank 160 and the ink refilling container 200 in this case.

In refilling the ink tank 160 with ink, the user first fits the first protruding portions 212 of the ink refilling container 200 into the first grooves 162 formed in the mouth portion 164 of the ink tank 160. In this operation, in a case where the first protruding portions 212 are misaligned with the first grooves 162, end surfaces of the first protruding portions 212 come into abutting contact with an end surface of the mouth portion 164. However, with this abutting contact state maintained, the ink refilling container 200 is rotated to slide the first protruding portions 212 on the end surface of the mouth portion 164 to allow the first protruding portions 212 to be fitted into the first grooves 162. Each of the second grooves 163 is narrower than each of the first grooves 162, inhibiting the first protruding portions 212 to be fitted into the second grooves 163.

Figure 15B:
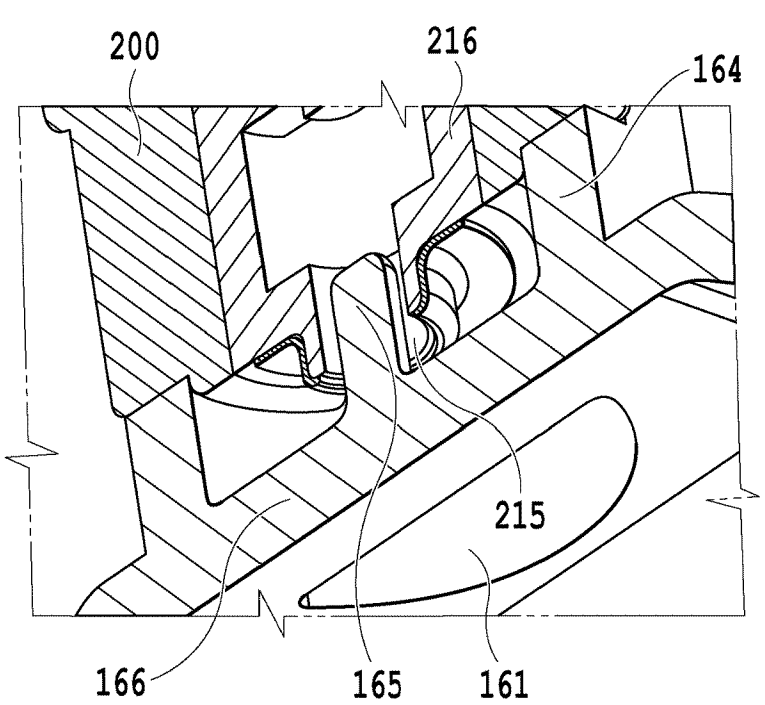
FIGS. 15A and 15B are sectional perspective views illustrating that a boss penetrates a film in an ink refilling container illustrated in FIGS. 13A to 13C.
Figure 15A:
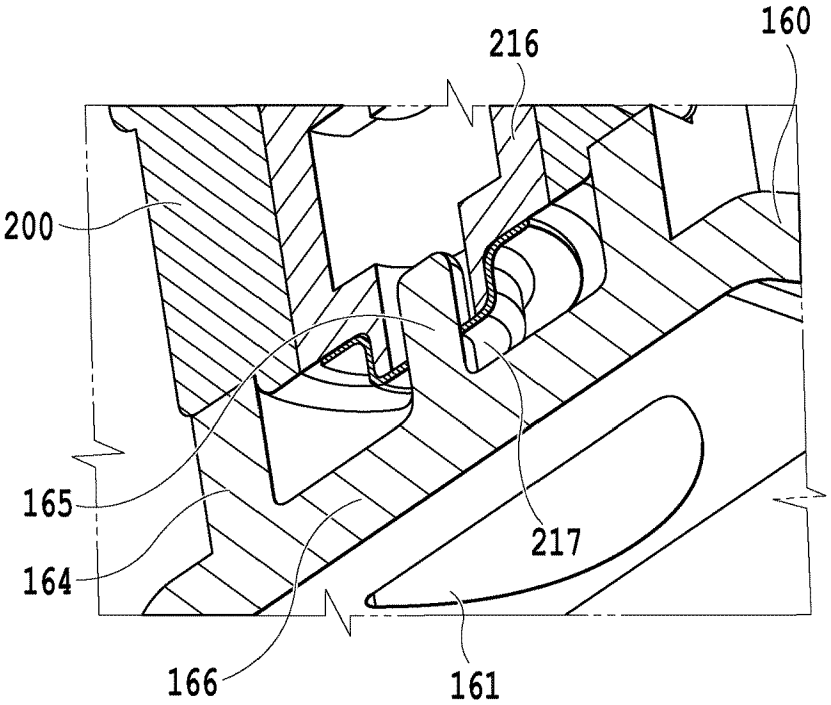

In a case where the ink to be stored in the ink tank 160 is of the same type as that of the ink stored in the ink refilling container 200, the first protruding portions 212 are fitted into the first grooves 162 and then the second protruding portions 213 are fitted into the second grooves 163. As a result, the ink refilling container 200 can further be pushed in toward the ink tank 160. During a process in which the second protruding portions 213 and the second grooves 163 are fitted together to push in the ink refilling container 200 toward the ink tank 160, the boss 165 penetrates the film 217 as illustrated in FIG. 15A. Once a hole is formed in the film 217, the hole is enlarged to have a larger diameter than the boss 165 due to an elastic force of the film 217 (see FIG. 15B). Thus, a flow of the ink from the ink refilling container 200 to the ink tank 160 is prevented from being hindered by the film 217. In conjunction with refilling of the ink tank 160 with ink, the air in the internal space in the ink tank 160 is expelled to the exterior through the air communication port 102. This inhibits exchange of the gas with the liquid from being hindered. Thus, the ink tank 160 is smoothly refilled with the ink from the ink refilling container 200. The air communication port 102 suppresses an increase in the internal pressure in the ink tank 160, inhibiting ink from spattering when the ink refilling container 200 is removed from the ink tank 160.

On the other hand, even in a case where the type of the ink to be stored in the ink tank 160 is different from the type of the ink stored in the ink refilling container 200, the first protruding portions 212 engage partly with the first grooves 162. However, the second protruding portions 213 are misaligned with the second grooves 163, inhibiting the first protruding portions 212 from being fitted into the first grooves 162. Thus, the second protruding portions 213 are in abutting contact with the end surface of the mouth portion 164, precluding the ink refilling container 200 from being further pushed in toward the ink tank 160. In this state, the ink pour-out port 211 in the ink refilling container 200 fails to come into abutting contact with the boss of the ink tank 160 as illustrated in FIG. 14C and thus remains sealed by the film 217. Therefore, the ink tank 160 is inhibited from being refilled with the ink from the ink refilling container 200.

As described above, in the third embodiment, the ink tank 160 can be refilled with the proper ink by an easy operation of rotating the ink refilling container 200 with the first protruding portions 212 in abutting contact with the mouth portion 164 of the ink tank 160 so as to fit the first protruding portions 212 into the first grooves 162. Even in a case where an erroneous attempt is made to refill the ink tank 160 with a different type of ink, no ink flows out from the ink refilling container 200, allowing prevention of possible mis-injection of ink into the ink tank 160. This inhibits color mixture in the ink tank 160.

Fourth Embodiment

Now, a fourth embodiment of the present invention will be described with reference to FIGS. 16A to 16C. The same portions as those in the third embodiment or portions corresponding to particular portions in the third embodiment are denoted by the same reference numerals and will not be described in detail.

Figures 16A, 16B, 16C:
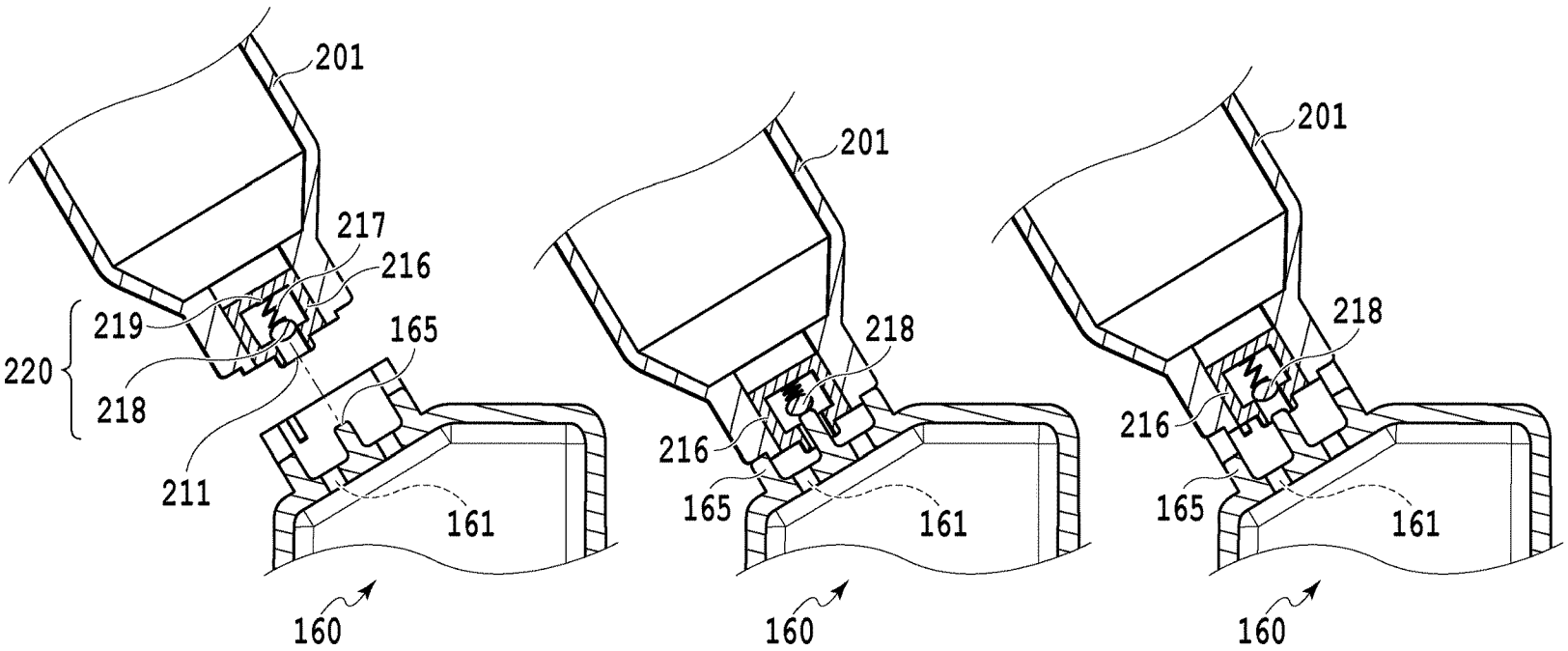
FIGS. 16A to 16C are longitudinal sectional views illustrating an ink refilling operation in a fourth embodiment.

In the fourth embodiment, instead of the film 217 in the third embodiment, a valve 220 illustrated in FIG. 16A is provided as a unit configured to avoid inadvertent outflow of ink through the ink injection port. The valve 220 is provided in the inner cylindrical portion 216 with the ink pour-out port 211 formed therein, and includes a valve disc 218 provided to enable the ink pour-out port 211 to be occluded and opened and a spring 219 that exerts a bias force in a direction in which the ink pour-out port 211 is occluded. As illustrated in FIG. 16A, in a case where the valve disc 218 is separated from the ink tank 160, the valve disc 218 occludes the ink pour-out port 211 due to the bias force of the spring 219. Thus, the ink inside the ink refilling container 200 is inhibited from flowing out even in a case where the ink pour-out port 211 of the ink refilling container 200 is directed downward. The other portions are the same as the corresponding portions of the third embodiment. That is, also in the fourth embodiment, the ink refilling container 200 is provided with the first fitting unit as is the case with the third embodiment, and the ink tank 160 is provided with the second fitting unit.

In a case where the type of the ink stored in the ink refilling container 200 matches the type of the ink to be delivered to the ink tank 160, the ink pour-out port in the ink refilling container 200 is pushed into the mouth portion 164 of the ink tank 160. As a result, as illustrated in FIG. 16B, the boss 165 provided on the ink tank 160 presses the valve disc 218 occluding the ink pour-out port 211 to separate the valve disc 218 from the ink pour-out port 211. Consequently, the ink in the ink refilling container 200 is fed into the ink tank 160 through the ink pour-out port 211 and the ink injection port 161.

On the other hand, in a case where the type of the ink to be stored in the ink tank 160 does not match the type of the ink stored in the ink refilling container 200, the valve disc 218 of the ink refilling container 200 fails to reach the position where the valve disc 218 comes into abutting contact with the boss 165 as illustrated in FIG. 16C. As a result, the valve disc 218 keeps the ink injection port occluded, inhibiting the ink tank 160 from being refilled with the ink from the ink refilling container 200.

As described above, the ink tank 160 can be refilled with the proper ink by an easy operation as is the case with the third embodiment. Even in a case where an erroneous attempt is made to refill the ink tank with a different type of ink, no ink flows out from the ink refilling container 200, allowing prevention of possible mis-injection of ink into the ink tank 160. This inhibits color mixture in the ink tank. In the fourth embodiment, in a case where the ink refilling container 200 is separated from the ink tank 160, the ink pour-out port 211 is automatically occluded by the valve 220. Thus, even in a case where the ink refilling operation is suspended with ink remaining in the ink refilling container 200, no ink flows out through the ink pour-out port 211. Even without preparation of a separate cover that seals the ink pour-out port 211, the ink refilling container 200 with ink remaining therein can be stored. Consequently, handling of the ink refilling containers can be simplified.

Fifth Embodiment

Now, a fifth embodiment of the present invention will be described with reference to FIGS. 17A to 18. The same portions as those in the third embodiment or portions corresponding to particular portions in the third embodiment are denoted by the same reference numerals and will not be described in detail.

In a printing apparatus in which the inside of the ink tank 160 is pressurized to feed ink to the print head 15, the inside of the ink tank 160 needs to be pressurized during ink refilling. Therefore, in a case where, in the configuration illustrated in the third embodiment, the ink tank is precluded from being provided with the air communication port 102, the air in the ink tank 160 may be unlikely to be expelled during ink refilling, precluding smooth refilling with ink.

Figure 17B:
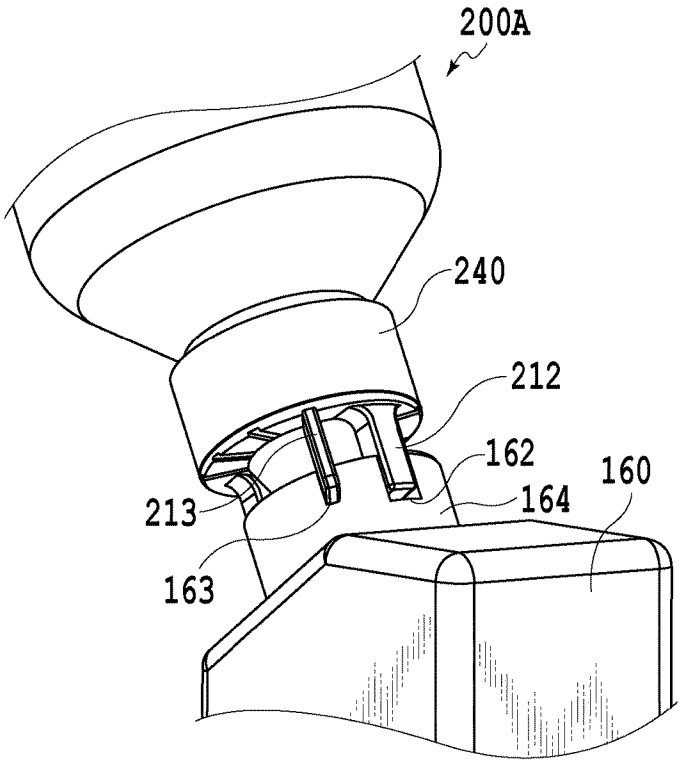
FIGS. 17A and 17B are perspective views illustrating an ejecting apparatus in a fifth embodiment.
Figure 17A:
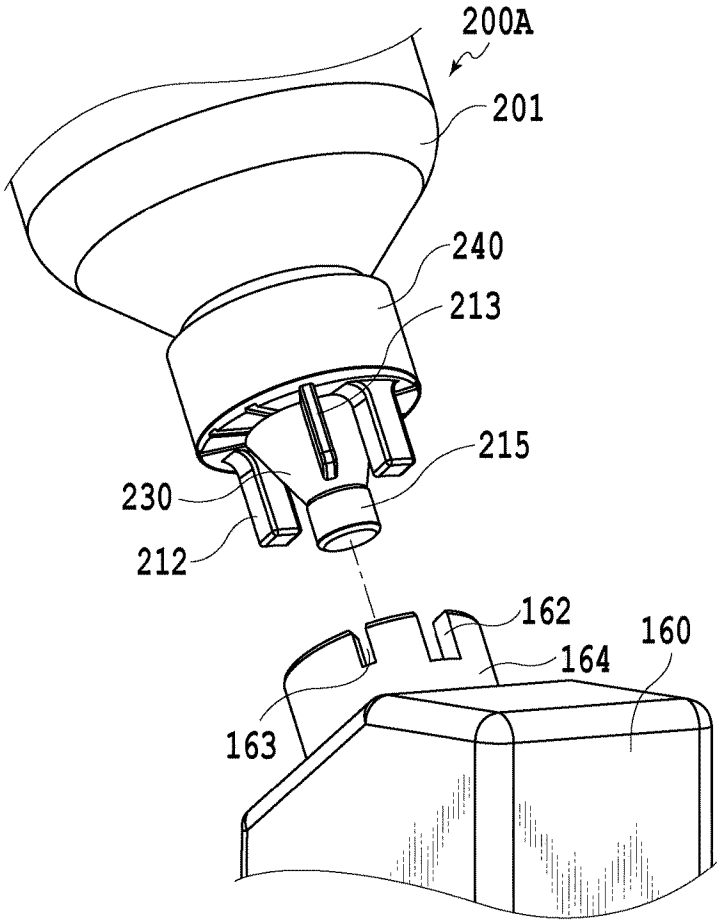
Figure 18:
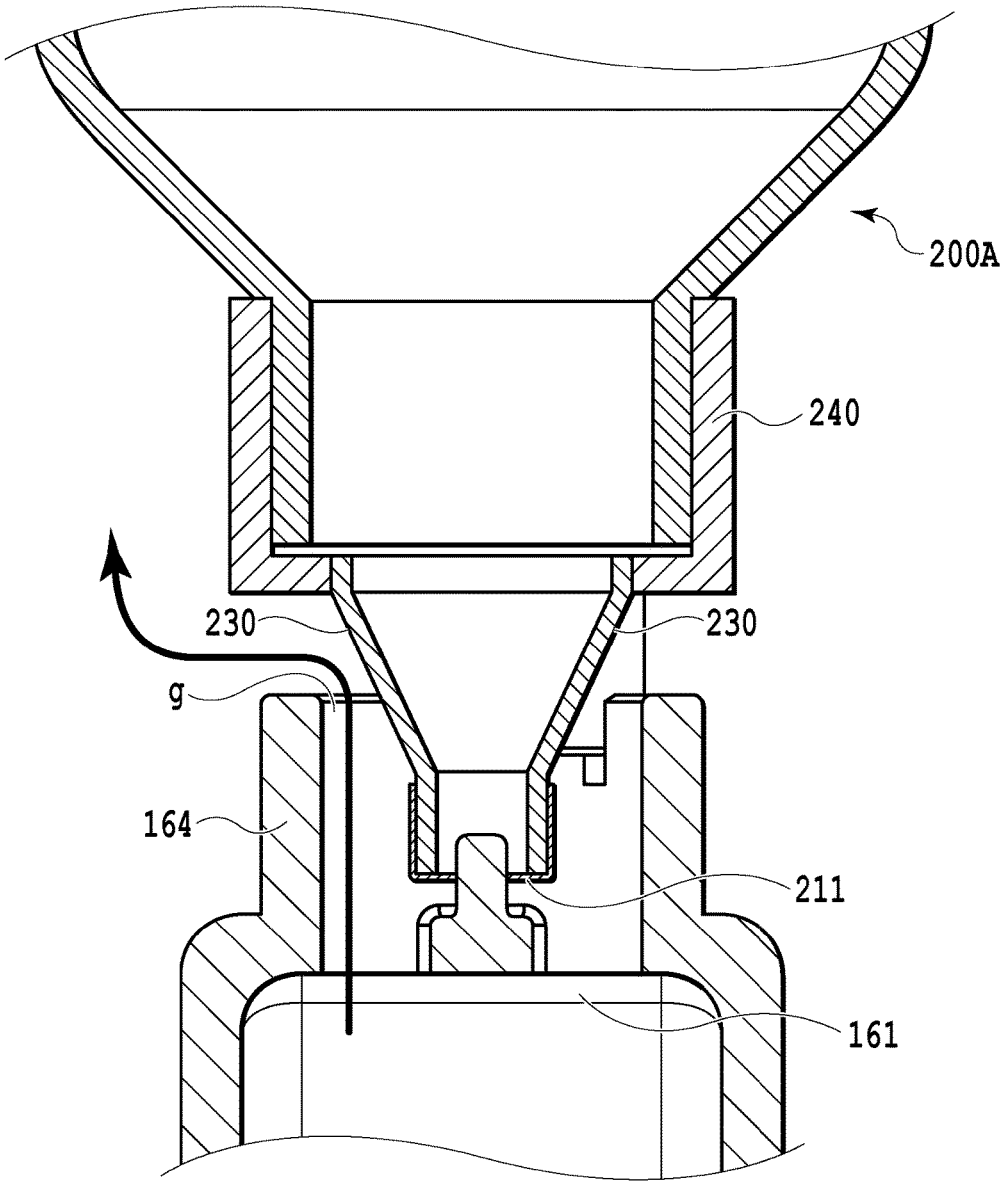
FIG. 18 is a longitudinal side view of FIG. 17B.

Thus, in the fifth embodiment, an ink refilling container 200A with a configuration illustrated in FIGS. 17A to 18 is applied to a printing apparatus including the ink tank 160 not having the air communication port 102. The ink refilling container 200A illustrated herein includes an inclined surface 230 formed at a tip of the main body portion 201 and shaped like a truncated cone, with the ink pour-out port 211 formed at a tip of the inclined surface 230. The first protruding portions 212 and the second protruding portions 213, which form the first fitting unit of the ink refilling container 200A, are provided on an intermediate portion 240 positioned closer to the main body portion 201 than the inclined surface 230.

FIG. 17B illustrates that the first protruding portions 212 and the second protruding portions 213 of the ink refilling container 200A are fitted into the first grooves 162 and the second grooves 163, respectively, in the ink tank 160 to refill the ink tank 160 with the ink from the ink refilling container 200. FIG. 18 is a sectional view of the ink refilling container 200 and the ink tank 160 in this case.

As illustrated in FIG. 18, in a case where the ink tank 160 is refilled with the ink from the ink refilling container 200, a gap g is formed between the inclined surface 230 of the ink refilling container 200 and the mouth portion 164 of the ink tank 160. Thus, in conjunction with refilling of the inside of the ink tank 160 with the ink from the ink refilling container 200, the air in the ink tank 160 is expelled to the exterior through the gap g as illustrated by an arrow. Thus, the ink tank 160 can be smoothly refilled with ink.

Other Embodiments

In the above-described embodiments, a label indicating the type of the ink may be attached to a bottom surface of each of the ink refilling containers 200, 200A. In this case, the label attached to the bottom portion directed upward when ink refilling is performed allows the user to recognize the type of the ink to be delivered, such as shown at label 1201 in FIG. 3. This also enables a reduction in the time needed for ink refilling and in mis-injection of ink into the ink tank.

In the first embodiment, a protruding portion (boss) similar to the protruding portion in the third embodiment may be provided at the ink pour-out port 18 in the ink tank. That is, when the recessed portions 24*a*, 24*b* of the ink refilling container 20 are fitted over the protruding portions 17*a*, 17*b* of the ink tank 16, the boss may penetrate the sealing material provided in the ink pour-out port 18 in the ink refilling container 20. Consequently, the operation of refilling the ink tank 16 with ink through the ink pour-out port 211 can be further simplified. Moreover, in the first embodiment, the valve 220 as illustrated in the fourth embodiment may be provided in the ink injection port 18 in the ink tank.

In the first and second embodiments, it is possible to change, as needed, the number of first fitting units (protruding portions) formed on the ink tank and the number of second fitting units (recessed portions) formed in the ink refilling container depending on the type of the ink used. Similarly, in the third to fifth embodiments, it is possible to change, as needed, the number of first fitting units (grooves) formed in the ink tank and the number of second fitting units (protruding portions) formed on the ink refilling container depending on the type of the ink used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-098057 filed May 16, 2016, which is hereby incorporated by reference wherein in its entirety.

What is claimed is:

1. A liquid ejecting apparatus comprising:

a print head configured to eject a liquid;

a liquid storage unit including a liquid injection port protruding in a first direction through which the liquid is injected, and a pressing member provided inside the liquid injection port, the liquid storage unit storing the liquid to be supplied to the print head;

a first shape portion extending by a first length from an opening of the liquid injection port in the first direction and being formed with a first width in a circumferential direction of the opening;

a second shape portion extending by a second length shorter than the first length from the opening of the liquid injection port in the first direction and being formed with a second width shorter than the first width in the circumferential direction of the opening; and a liquid refilling container configured to refill the liquid into the liquid storage unit, the liquid refilling container including a liquid pour-out port through which the liquid is poured out, a sealing member configured to seal the liquid pour-out port, an inclined portion having a tip at which the liquid pour-out port is formed, a third shape portion enabled to engage with the first shape portion, and a fourth shape portion enabled to engage with the second shape portion, wherein a distance between the third shape portion and an opening of the liquid pour-out port is less than a distance between the fourth shape portion and the opening of the liquid pour-out port, and wherein, in a case where the first shape portion engages with the third shape portion and the second shape portion engages with the fourth shape portion, the pressing member presses the sealing member to open the liquid pour-out port, wherein in a case where the first shape portion and the third shape portion engage with each other, and the second shape portion and the fourth shape portion do not engage with each other, the pressing member does not press the sealing member, wherein the first shape portions are formed at positions for which a positional relation relative to a center of the liquid pour-out port remains the same regardless of the type of the liquid stored in the liquid storage unit, and the second shape portions are formed at positions for which the positional relation varies depending on the type of the liquid stored in the liquid storage unit, wherein in a case where a type of the liquid to be stored in the liquid storage unit is different from a type of the liquid stored in the liquid refilling container, the first shape portion engages with the third shape portion and the second shape portion does not engage with the fourth shape portion.

2. The liquid ejecting apparatus according to claim 1, wherein the sealing member is a film.

3. The liquid ejecting apparatus according to claim 1, wherein the sealing member is a valve biased in a direction in which the liquid pour-out port is occluded.

4. The liquid ejecting apparatus according to claim 1, wherein even after the liquid pour-out port is opened by the pressing member, the sealing member is enabled to occlude the liquid pour-out port in a case where the liquid refilling container is separated from the liquid storage unit.

5. The liquid ejecting apparatus according to claim 1, wherein, in a case where the liquid is injected from the liquid refilling container into the liquid storage unit, an exchange of air with the liquid in the liquid refilling container is performed in the sealing member.

6. The liquid ejecting apparatus according to claim 1, wherein a label indicating a type of the liquid stored in the liquid refilling container is attached to a side surface of the liquid refilling container.

7. The liquid ejecting apparatus according to claim 1, further comprising a cover configured to cover the liquid storage unit.

8. The liquid ejecting apparatus according to claim 1, further comprising a cap which can close the opening of the liquid injection port.

9. The liquid ejecting apparatus according to claim 1, further comprising a tube which connects the print head with the liquid storage unit.

10. The liquid ejecting apparatus according to claim 1, wherein the liquid includes black ink, magenta ink, yellow ink, and cyan ink.

11. A liquid ejecting apparatus that liquid is refilled from a liquid refilling container including a liquid pour-out port, an inclined portion having a tip at which the liquid pour-out port is formed, and a sealing member configured to seal the liquid pour-out port, the liquid ejection apparatus comprising:

a print head configured to eject a liquid;

a liquid storage unit configured to store the liquid to be supplied to the print head, the liquid storage unit including a liquid injection port protruding in a first direction through which the liquid is injected from the liquid refilling container and a pressing member provided inside the liquid injection port;

a first shape portion extending by a first length from an opening of the liquid injection port in the first direction and being formed with a first width in a circumferential direction of the opening; and a second shape portion extending by a second length shorter than the first length from the opening of the liquid injection port in the first direction and being formed with a second width shorter than the first width in the circumferential direction of the opening, wherein the liquid refilling container is provided with a third shape portion whose distance to an opening of the liquid pour-out port is a first distance, and a fourth shape portion whose distance to the opening of the liquid pour-out port is a second distance longer than the first distance, and wherein in a case where the first shape portion engages with the third shape portion, and the second shape portion engages with the fourth shape portion, the pressing member presses the sealing member to open the liquid pour-out port, wherein in a case where the first shape portion and the third shape portion engage with each other, and the second shape portion and the fourth shape portion do not engage with each other, the pressing member does not press the sealing member, wherein the first shape portions are formed at positions for which a positional relation relative to a center of the liquid pour-out port remains the same regardless of the type of the liquid stored in the liquid storage unit, and the second shape portions are formed at positions for which the positional relation varies depending on the type of the liquid stored in the liquid storage unit, wherein in a case where a type of the liquid to be stored in the liquid storage unit is different from a type of the liquid stored in the liquid refilling container, the first shape portion engages with the third shape portion and the second shape portion does not engage with the fourth shape portion.

12. A liquid refilling container for refilling liquid to a printing apparatus including a print head configured to eject a liquid, a liquid storage unit including a liquid injection port protruding in a first direction through which the liquid is injected, the liquid storage unit storing the liquid to be supplied to the print head, a first shape portion extending by a first length from an opening of the liquid injection port in the first direction and being formed with a first width in a circumferential direction of the opening, and a second shape portion extending by a second length shorter than the first length from the opening of the liquid injection port in the first direction and being formed with a second width shorter than the first width in the circumferential direction of the opening, the liquid refilling container comprising:

a liquid pour-out port through which the liquid is poured out;

a sealing member configured to seal the liquid pour-out port;

an inclined portion having a tip at which the liquid pour-out port is formed;

a third shape portion enabled to engage with the first shape portion;

a fourth shape portion enabled to engage with the second shape portion;

wherein a distance between the third shape portion and an opening of the liquid pour-out port is less than a distance between the fourth shape portion and the opening of the liquid pour-out port; and wherein in a case where the third shape portion engages with the first shape portion, and the fourth shape portion engages with the second shape portion, a pressing member of the printing apparatus presses the sealing member so that the liquid pour-out port opens, wherein in a case where the first shape portion and the third shape portion engage with each other, and the second shape portion and the fourth shape portion do not engage with each other, the pressing member does not press the sealing member, wherein the first shape portions are formed at positions for which a positional relation relative to a center of the liquid pour-out port remains the same regardless of the type of the liquid stored in the liquid storage unit, and the second shape portions are formed at positions for which the positional relation varies depending on the type of the liquid stored in the liquid storage unit, wherein in a case where a type of the liquid to be stored in the liquid storage unit is different from a type of the liquid stored in the liquid refilling container, the first shape portion engages with the third shape portion and the second shape portion does not engage with the fourth shape portion.

* * * * *